US011603838B2

(12) United States Patent
Meinig et al.

(10) Patent No.: US 11,603,838 B2
(45) Date of Patent: Mar. 14, 2023

(54) VANE CELL PUMP

(71) Applicant: Schwäbische Hüttenwerke Automotive GmbH, Aalen-Wasseralfingen (DE)

(72) Inventors: Uwe Meinig, Bad Saulgau (DE); Robin Rene Rauscher, Meckenbeuren (DE); Lothar Preisler, Bad Schussenried (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 0 days.

(21) Appl. No.: 17/066,810

(22) Filed: Oct. 9, 2020

(65) Prior Publication Data

US 2021/0108634 A1 Apr. 15, 2021

(30) Foreign Application Priority Data

Oct. 10, 2019 (DE) ..... 10 2019 127 389.7

(51) Int. Cl.
*F03C 2/00* (2006.01)
*F03C 4/00* (2006.01)
(Continued)

(52) U.S. Cl.
CPC ..... *F04C 2/3446* (2013.01); *F01C 21/0863* (2013.01); *F01C 21/106* (2013.01);
(Continued)

(58) Field of Classification Search
CPC ..... F04C 2/344; F04C 2/3441; F04C 2/3446; F04C 18/3446; F04C 15/00;
(Continued)

(56) References Cited

U.S. PATENT DOCUMENTS 3,216,363 A * 11/1965 Snow ..... F04C 2/3446 418/135
4,386,891 A * 6/1983 Riefel ..... F04C 2/3446 418/82

(Continued)

FOREIGN PATENT DOCUMENTS

DE 10259894 A1 * 7/2003 ..... F04C 2/3446
JP 2010031715 A 2/2010

(Continued)

OTHER PUBLICATIONS

German Search Report issued in German Patent Application No. 10 2019 127 389.7, dated Oct. 5, 2020, 8 pages.

(Continued)

*Primary Examiner* — Theresa Trieu
(74) *Attorney, Agent, or Firm* — RatnerPrestia

(57) ABSTRACT

A vane cell pump, including: a rotor and a plurality of vanes rotatable with the rotor, wherein the rotor includes a sub-vane chamber for each vane, and each vane forms a shifting wall of the sub-vane chamber assigned to it; first and second end-facing walls adjoining the rotor on end-facing sides and which, in order to control pressure to the sub-vane chamber, include sub-vane cavities which extend in the circumferential direction of the rotor and include control edges as viewed in the circumferential direction; wherein the control edge of the sub-vane cavity of the first end-facing wall, and the control edge of the sub-vane cavity of the second
(Continued)

Figure 1:
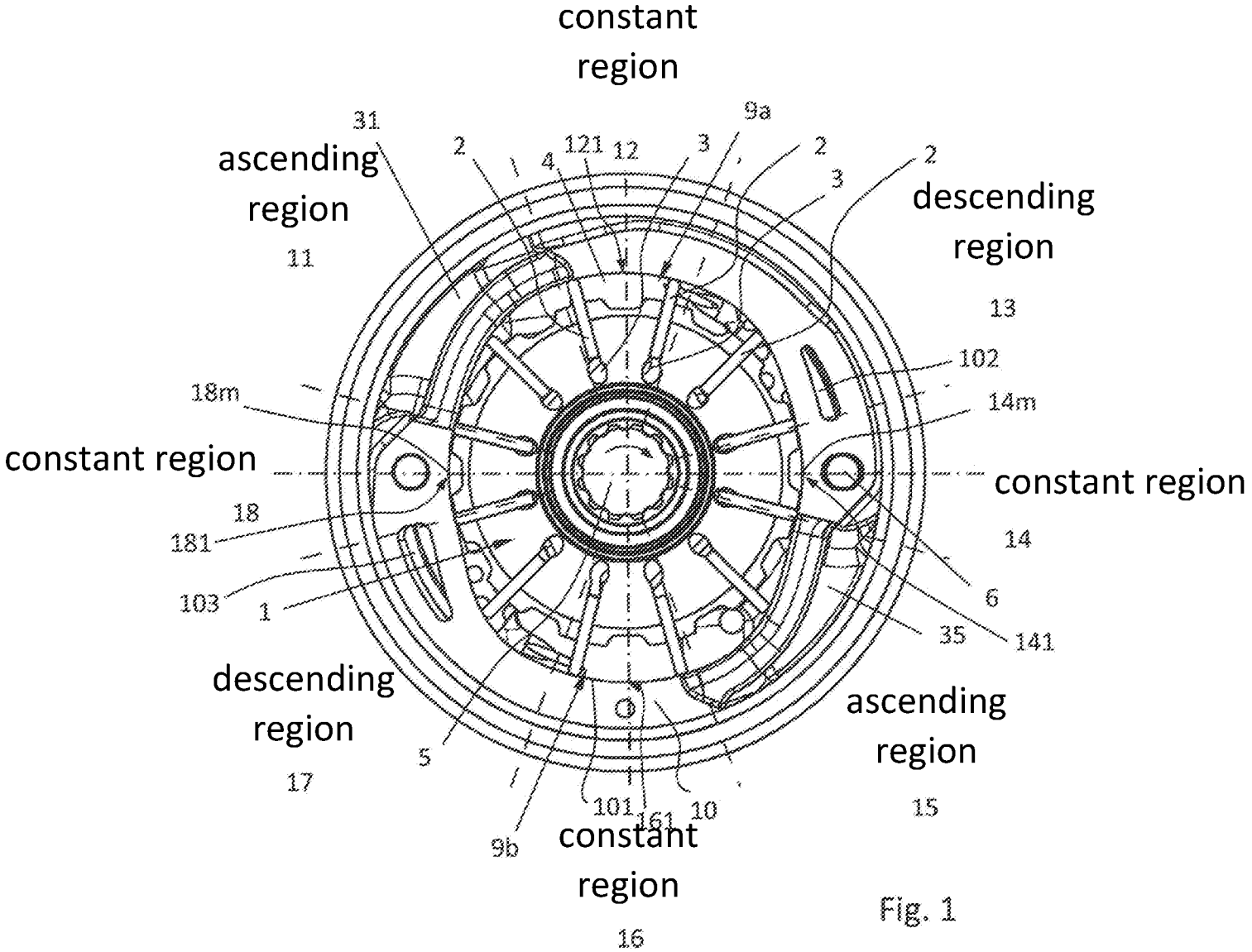

end-facing wall which is similar to it, are arranged angularly offset about the rotational axis as the apex with respect to each other.

15 Claims, 3 Drawing Sheets

(51) Int. Cl.

| | |
|---|---|
| ***F04C 15/00*** | (2006.01) |
| ***F04C 2/00*** | (2006.01) |
| ***F04C 2/344*** | (2006.01) |
| ***F01C 21/08*** | (2006.01) |
| ***F01C 21/10*** | (2006.01) |
| ***F04C 18/344*** | (2006.01) |

(52) U.S. Cl.
CPC ..... *F01C 21/108* (2013.01); *F04C 2/3441* (2013.01); *F04C 15/0023* (2013.01); *F04C 18/3446* (2013.01); *F04C 2210/14* (2013.01)

(58) Field of Classification Search
CPC ..... F04C 15/0023; F04C 2210/14; F04C 2240/20; F04C 2240/30; F04C 2270/701; F01C 21/0863; F01C 21/106; F01C 21/108
See application file for complete search history.

(56) References Cited

U.S. PATENT DOCUMENTS

| | | | | |
|---|---|---|---|---|
| 5,147,183 | A | 9/1992 | Gettel | |
| 5,490,770 | A * | 2/1996 | Oogushi | F01C 21/0863 418/82 |
| 6,244,830 | B1 | 6/2001 | Agner | |
| 2002/0122735 | A1 * | 9/2002 | Bishop | F04C 2/3446 418/133 |
| 2013/0280118 | A1 | 10/2013 | Akatsuka et al. | |
| 2018/0003176 | A1 * | 1/2018 | Welte | F04C 2/3446 |
| 2018/0283373 | A1 | 10/2018 | Sugihara et al. | |

FOREIGN PATENT DOCUMENTS

| | | | |
|---|---|---|---|
| JP | 2017115808 | A | 6/2017 |
| WO | 03056180 | A1 | 7/2003 |
| WO | 2017047486 | A1 | 3/2017 |
| WO | 2018043434 | A1 | 3/2018 |

OTHER PUBLICATIONS

Extended European Search Report issued in European Patent Application No. 20 200 950.2, dated Nov. 23, 2020, 6 pages.

* cited by examiner

VANE CELL PUMP

CROSS REFERENCE TO RELATED APPLICATIONS

This application claims benefit of priority to German Patent Application No. 10 2019 127 389.7, filed Oct. 10, 2019, the contents of such application being incorporated herein by reference.

FIELD OF THE INVENTION

The invention relates to a displacement pump which is embodied as a vane cell pump, in particular a mono-flux or dual-flux and/or two-stroke vane cell pump. The vane cell pump can deliver a fluid, for example a gas or a liquid such as for example oil, from a suction side of the pump to a pressure side of the pump. The pump can for example be designed to be installed in a vehicle, in particular a motor vehicle. The pump can for example be designed to deliver lubricating oil for a consumer in a motor vehicle, for example an engine or a transmission, in particular an automatic transmission, for example for a motor vehicle. The pump can for example be arranged or attached in or on a transmission or a transmission housing.

BACKGROUND OF THE INVENTION

Vane cell pumps are known from the prior art which comprise a rotor which can be rotated relative to a housing and which comprises a multitude of slot-shaped cavities in each of which a vane is arranged and which guide the vane such that it can be shifted radially. A contour ring of the housing comprises an inner contour which is formed by its inner circumference and extends around the rotor and along which the vanes slide while the rotor is being rotated, so as to deliver fluid from a suction side to a pressure side of the pump. In order to reduce the risk of the vanes lifting off the inner contour, it is a known teaching that the rotor forms a sub-vane chamber below each vane, wherein said chamber can be pressurised with fluid, thus urging the vane of each sub-vane chamber radially outwards against the inner contour. Urging the vane against the inner contour increases the friction between the vanes and the inner contour, thus increasing wear and/or decreasing the level of efficiency of the pump.

SUMMARY OF THE INVENTION

An aspect of the invention is based on specifying a vane cell pump which exhibits high levels of efficiency but simultaneously reduces the risk of the vanes lifting off the inner contour of the contour ring. The intention is also for example to ensure good suction characteristics of the pump during a cold start. A part of the object may be regarded as being that of specifying a dual-flux pump in which the fluxes can be operated fully independently of each other and/or at different delivery-related and high-volumetric levels of efficiency.

An aspect of the invention is based on a vane cell pump, in particular a vane cell pump of or for a motor vehicle, which comprises a rotor, which can be rotated about a rotational axis, and a plurality of vanes which are guided by the rotor such that they can be shifted. A plurality of vanes can for example be arranged in a distribution, in particular a uniform distribution, over the circumference of the rotor and/or can be able to be shifted individually or independently of each other relative to the rotor. At least six vanes, and in particular 6, 8, 10, 12 or 14 vanes, can for example be provided. The vanes can in particular be able to be shifted relative to the rotor with at least a radial component or radially in relation to the rotational axis of the rotor.

The rotor can for example form a slot-shaped guide for each vane, said guide being formed so as to guide, in particular radially guide, the vane assigned to it, with a translational degree of freedom and in particular with one translational degree of freedom.

For each vane and/or slot-shaped guide, the rotor comprises a sub-vane chamber which can in particular be arranged between the rotational axis of the rotor and the slot-shaped guide assigned to the sub-vane chamber. Each vane forms a shifting wall of the sub-vane chamber assigned to it. By applying pressure to and/or relieving pressure on a fluid in the sub-vane chamber, it is possible to control a force acting on the shifting wall of the vane and thus for example the force with which the respective vane is pressed against the inner contour of a contour ring or stroke ring.

The vane cell pump can for example comprise a contour ring, in particular a stroke ring, which comprises an inner contour (inner circumferential surface) which extends around the rotational axis of the rotor and along which the radially outer ends of the vanes slide when the rotor is rotated, in particular when the vane cell pump is in operation.

The inner contour of the contour ring can comprise: at least one ascending region, wherein a vane is moved out of the rotor, in particular at least assisted by a fluid pressure in the sub-vane chamber, as it slides over the ascending region; and at least one descending region, wherein a vane is moved into the rotor, in particular counter to a fluid pressure in the sub-vane chamber, as it slides over the descending region.

Between an end of the ascending region and the beginning of a descending region—in relation to the rotational direction of the rotor envisaged for operations, the inner contour can optionally comprise a region which is adapted to define an upper dead centre for the vane which is sliding over said region, i.e. a position for the vane in which it is maximally moved out of the rotor. While the vane is moved through this region, it is preferably at least approximately stationary in relation to the rotor. This region can therefore be referred to as a constant region or, more accurately, the upper constant region. When the vane is moved from the ascending region to the descending region via the upper constant region, the direction of movement of the vane in relation to the rotor is reversed.

Between an end of the descending region and the beginning of an ascending region—in relation to the rotational direction of the rotor envisaged for operations, the inner contour can optionally comprise a region which is adapted to define a lower dead centre for the vane which is sliding over said region, i.e. a position for the vane in which it is maximally moved into the rotor. While the vane is moved through this region, it is preferably at least approximately stationary in relation to the rotor. This region can therefore be referred to as a constant region or, more accurately, the lower constant region. When the vane is moved from the descending region to the ascending region via the lower constant region, the direction of movement of the vane in relation to the rotor is reversed.

In a multi-flux or multi-stroke vane cell pump, the inner contour of the contour ring can comprise a first ascending region and a first descending region which are assigned to a first flux, i.e. a first fluid flow from a suction side or low-pressure side to a pressure side or high-pressure side, and at least a second ascending region and a second descending region which are assigned to a second flux, i.e. a second fluid flow from a suction side or low-pressure side to a pressure side or high-pressure side. A vane is moved out of the rotor, in particular at least assisted by a fluid pressure in the sub-vane chamber, when it slides over the ascending region, in particular the first and/or second ascending region, and is moved into the rotor, in particular counter to a fluid pressure in the sub-vane chamber, when it slides over the descending region, in particular the first and/or second descending region.

In a mono-flux or single-stroke vane cell pump, each vane is extended once and retracted once during a complete revolution of the rotor. In a dual-flux or two-stroke vane cell pump, each vane is extended, retracted, extended and retracted again, i.e. extended twice and retracted twice, during a complete revolution of the rotor. In vane cell pumps having more than two fluxes and/or strokes, for example triple-flux and/or three-stroke vane cell pumps, each vane is retracted and extended correspondingly more often during a complete revolution of the rotor.

Between an end of the first ascending region and a beginning of the first descending region and/or between an end of the second ascending region and a beginning of the second descending region—in relation to the rotational direction of the rotor envisaged for operations, the respective inner contour of the contour ring can optionally comprise a region which is adapted to define an upper dead centre for the vane which is sliding over said region (cf. above). This region can be referred to as a constant region or, more accurately, the first upper constant region if it is formed between the end of the first ascending region and the beginning of the first descending region, and as the second upper constant region if it is formed between the end of the second ascending region and the beginning of the second descending region.

Between an end of the first descending region and the beginning of the second ascending region and/or between an end of the second descending region and the beginning of the first ascending region—in relation to the rotational direction of the rotor envisaged for operations, the respective inner contour can optionally comprise a region which is adapted to define a lower dead centre for the vane which is sliding over said region (cf. above), i.e. a position for the vane in which it is maximally moved into the rotor. This region can be referred to as a constant region or, more accurately, the first lower constant region if it is formed between the end of the first descending region and the beginning of the second ascending region, and as the second lower constant region if it is formed between the end of the second descending region and the beginning of the first ascending region.

The vane cell pump can comprise an end-facing wall, in particular a first end-facing wall, which adjoins the rotor on an end-facing side on one side of the rotor, for example on a first side. The vane cell pump can comprise an end-facing wall, in particular a second end-facing wall, which adjoins the rotor on an end-facing side on the side of the rotor facing away from said one side, being for example the first side, in particular on a second side of the rotor. The first end-facing wall can comprise at least one and preferably a plurality of sub-vane cavities which extend in the circumferential direction and which can in particular be referred to or formed as sub-vane supply cavities or sub-vane supply pockets or sub-vane supply grooves, in order to control or supply pressure to the sub-vane chambers of the rotor. Alternatively or additionally, the second end-facing wall can comprise at least one and preferably a plurality of sub-vane cavities which extend in the circumferential direction and which can in particular be referred to or formed as sub-vane supply cavities or sub-vane supply pockets or sub-vane supply grooves, in order to control or supply pressure to the sub-vane chambers of the rotor.

The contour ring, the first end-facing wall and the second end-facing wall can be separate parts which form a housing when assembled. The contour ring, the first end-facing wall and the second end-facing wall are preferably assembled such that they are non-rotational about the rotational axis of the rotor in relation to each other. Alternatively, the contour ring can be an integral part of the first end-facing wall or second end-facing wall.

The first end-facing wall and/or second end-facing wall can in particular (each) comprise—in a mono-flux vane cell pump—an ascending sub-vane cavity and a descending sub-vane cavity, or—in a dual-flux vane cell pump—a first ascending sub-vane cavity, a first descending sub-vane cavity, a second ascending sub-vane cavity and a second descending sub-vane cavity, or—in a higher-fluxed vane cell pump, i.e. one with even more fluxes—a corresponding number of additional sub-vane cavities. The ascending sub-vane cavity serves to control the pressure of a sub-vane chamber when its vane is situated in or sliding along the ascending region of the inner contour. The descending sub-vane cavity serves to control the pressure of a sub-vane chamber when its vane is situated in or sliding along the descending region of the inner contour.

The first ascending sub-vane cavity serves in particular to control pressure to a sub-vane chamber and/or is connected in fluid communication with a sub-vane chamber when its vane is situated in or sliding along the first ascending region of the inner contour. The second ascending sub-vane cavity serves in particular to control pressure to a sub-vane chamber and/or is connected in fluid communication with a sub-vane chamber when its vane is situated in or sliding along the second ascending region of the inner contour. The first descending sub-vane cavity serves in particular to control pressure to a sub-vane chamber and/or is connected in fluid communication with a sub-vane chamber when its vane is situated in or sliding along the first descending region of the inner contour. The second descending sub-vane cavity serves in particular to control pressure to a sub-vane chamber and/or is connected in fluid communication with a sub-vane chamber when its vane is situated in or sliding along the second descending region of the inner contour.

The sub-vane cavities can be formed in the shape of grooves or pockets. The sub-vane cavities can extend in the circumferential direction, in particular in a curve around the rotational axis. The sub-vane cavities can in particular each form an arc portion encircling the rotational axis of the rotor and can be arranged sequentially or in series in the encircling direction.

The sub-vane cavities of the first end-facing wall can for example be arranged such that the sub-vane chambers and/or each of the sub-vane chambers are successively connected in fluid communication with the sub-vane cavities of the first end-facing wall during a complete (360°) revolution of the rotor, wherein it is preferable if a sub-vane chamber can only ever be connected in fluid communication with one sub-vane cavity of the first end-facing wall or, in other words, a sub-vane chamber cannot be simultaneously connected in fluid communication with more than one sub-vane cavity of the first end-facing wall in any possible rotational positions of the rotor.

Alternatively or additionally, the sub-vane cavities of the second end-facing wall can be arranged such that the sub-vane chambers and/or each of the sub-vane chambers are successively connected in fluid communication with the sub-vane cavities of the second end-facing wall during a complete (360°) revolution of the rotor, wherein it is preferable if a sub-vane chamber can only ever be connected in fluid communication with one sub-vane cavity of the second end-facing wall or in other words a sub-vane chamber cannot be simultaneously connected in fluid communication with more than one sub-vane cavity of the second end-facing wall in any possible rotational positions of the rotor.

It is nonetheless preferable if a sub-vane chamber can be simultaneously connected in fluid communication with a sub-vane cavity of the first end-facing wall and a sub-vane cavity of the second end-facing wall. The rotor can in particular assume a rotational position in which a sub-vane chamber is simultaneously connected to a sub-vane cavity of the first end-facing wall and second end-facing wall. The rotor can for example assume a rotational position in which a sub-vane chamber is simultaneously connected to the first ascending sub-vane cavity of the first end-facing wall and second end-facing wall. The rotor can for example assume a rotational position in which a sub-vane chamber is simultaneously connected to the first descending sub-vane cavity of the first end-facing wall and second end-facing wall. The rotor can for example assume a rotational position in which a sub-vane chamber is simultaneously connected to the second ascending sub-vane cavity of the first end-facing wall and second end-facing wall. The rotor can for example assume a rotational position in which a sub-vane chamber is simultaneously connected to the second descending sub-vane cavity of the first end-facing wall and second end-facing wall.

A separating stay which fluidically separates adjacent sub-vane cavities from each other, or a hydraulic constriction such as for example a groove or channel which is open towards the rotor and fluidically connects adjacent sub-vane cavities to each other, can in particular be respectively formed on the first end-facing wall and/or second end-facing wall between the adjacent sub-vane cavities.

A separating stay can for example be formed on the first end-facing wall and/or on the second end-facing wall between the first descending sub-vane cavity and the second ascending sub-vane cavity. A separating stay can for example be formed on the first end-facing wall and/or on the second end-facing wall between the second descending sub-vane cavity and the first ascending sub-vane cavity.

A separating stay can for example be formed on the first end-facing wall, in particular respectively, between the first ascending sub-vane cavity and the first descending sub-vane cavity and/or between the second ascending sub-vane cavity and the second descending sub-vane cavity. A hydraulic constriction can for example be formed on the second end-facing wall between the first ascending sub-vane cavity and the first descending sub-vane cavity and/or between the second ascending sub-vane cavity and the second descending sub-vane cavity.

The separating stay or stays is/are preferably formed, for example between the first descending sub-vane cavity and the second ascending sub-vane cavity and/or between the second descending sub-vane cavity and the first ascending sub-vane cavity and/or between the first ascending sub-vane cavity and the first descending sub-vane cavity and/or between the second ascending sub-vane cavity and the second descending sub-vane cavity, such that it/they can seal a sub-vane chamber and/or fluidically separate it from the sub-vane cavities adjoining the relevant separating stay in a rotational position of the rotor.

Each of the sub-vane chambers can in particular feed towards the first end-facing wall via a first opening and towards the second end-facing wall via a second opening. The separating stay or stays is/are preferably dimensioned such that it/they can completely or substantially completely cover the first opening or the second opening in order to fluidically separate it from the adjoining sub-vane chambers.

The sub-vane cavities can each be enclosed or delineated in the circumferential direction or rotational direction of the rotor by a control edge which forms a beginning of a sub-vane cavity—in relation to the rotational direction of the rotor, and by a control edge which forms an end of the sub-vane cavity. The control edge can for example be formed by the transition between the sub-vane cavity and the adjoining separating stay or by a protrusion which forms or laterally delineates the hydraulic constriction.

One or more separating stays and/or sub-vane cavities of one end-facing wall, for example the first end-facing wall, and the separating stay of the other end-facing wall, for example the second end-facing wall, corresponding to the respective separating stay, or the sub-vane cavity of the other end-facing wall, for example the second end-facing wall, corresponding to the respective sub-vane cavity, lie opposite each other, i.e. at least partially or completely overlap in their projection along the rotational axis of the rotor.

An ascending sub-vane cavity of the first end-facing wall can for example lie opposite the ascending sub-vane cavity of the second end-facing wall, i.e. at least partially overlap the ascending sub-vane cavity of the second end-facing wall in a projection along the rotational axis of the rotor. Alternatively or additionally, a descending sub-vane cavity of the first end-facing wall can lie opposite the descending sub-vane cavity of the second end-facing wall, i.e. at least partially overlap the descending sub-vane cavity of the second end-facing wall in a projection along the rotational axis of the rotor. Two mutually opposite sub-vane cavities can be referred to as mutually similar sub-vane cavities.

For example:

- the first ascending sub-vane cavity of the first end-facing wall can lie opposite the first ascending sub-vane cavity of the second end-facing wall; and/or
- the first descending sub-vane cavity of the first end-facing wall can lie opposite the first descending sub-vane cavity of the second end-facing wall; and/or
- the second ascending sub-vane cavity of the first end-facing wall can lie opposite the second ascending sub-vane cavity of the second end-facing wall; and/or
- the second descending sub-vane cavity of the first end-facing wall can lie opposite the second descending sub-vane cavity of the second end-facing wall.

Alternatively or additionally, a separating stay which is formed between an ascending sub-vane cavity and a descending sub-vane cavity of the first end-facing wall can lie opposite a separating stay or hydraulic constriction which is formed between an ascending sub-vane cavity and a descending sub-vane cavity of the second end-facing wall, i.e. at least partially overlap the separating stay or hydraulic constriction. Two mutually opposite separating stays can be referred to as mutually similar separating stays.

For example:

- the separating stay which is formed between the first descending sub-vane cavity and the second ascending sub-vane cavity of the first end-facing wall can lie opposite the separating stay which is formed between the first descending sub-vane cavity and the second ascending sub-vane cavity of the second end-facing wall; and/or the separating stay which is formed between the second descending sub-vane cavity and the first ascending sub-vane cavity of the first end-facing wall can lie opposite the separating stay which is formed between the second descending sub-vane cavity and the first ascending sub-vane cavity of the second end-facing wall; and/or the separating stay which is formed between the first ascending sub-vane cavity and the first descending sub-vane cavity of the first end-facing wall can lie opposite the separating stay or hydraulic constriction (or protrusion thereof) which is formed between the first ascending sub-vane cavity and the first descending sub-vane cavity of the second end-facing wall; and/or the separating stay which is formed between the second ascending sub-vane cavity and the second descending sub-vane cavity of the first end-facing wall can lie opposite the separating stay or hydraulic constriction (or protrusion thereof) which is formed between the second ascending sub-vane cavity and the second descending sub-vane cavity of the second end-facing wall.

Based in particular on a vane cell pump as described in this document, a number of aspects of the invention will be described, which can optionally be combined with each other.

A first aspect of the invention relates to a vane cell pump comprising:

a rotor, which can be rotated about a rotational axis, and a plurality of vanes which are guided by the rotor such that they can be shifted, wherein the rotor comprises a sub-vane chamber for each vane, and each vane forms a shifting wall of the sub-vane chamber assigned to it;

a first end-facing wall which is adjoining on an end-facing side on a first side of the rotor and which, in order to supply or control pressure to the sub-vane chamber, comprises a sub-vane cavity which extends around the rotational axis of the rotor in the circumferential direction, in particular in the shape of an arc portion, and comprises a control edge which, in particular as viewed in the circumferential direction, can form a beginning or end of the sub-vane cavity, in particular in the rotational direction of the rotor envisaged for operations;

a second end-facing wall which is adjoining on an end-facing side on a second side of the rotor and which, in order to supply or control pressure to the sub-vane chamber, comprises a sub-vane cavity which extends around the rotational axis of the rotor in the circumferential direction, in particular in the shape of an arc portion, and comprises a control edge which, in particular as viewed in the circumferential direction, is similar to the control edge of the sub-vane cavity of the first end-facing wall and can form a beginning or end of the sub-vane cavity, in particular in the rotational direction of the rotor envisaged for operations, wherein the sub-vane cavity of the second end-facing wall lies opposite the sub-vane cavity of the first end-facing wall or at least partially overlaps the sub-vane cavity of the first end-facing wall in a projection along the rotational axis of the rotor, wherein the control edge of the sub-vane cavity of the first end-facing wall, and the control edge of the sub-vane cavity of the second end-facing wall which is similar to it, are formed differently from each other and/or are arranged offset, in particular angularly offset, with respect to each other.

The mutually similar control edges are in particular formed differently from each other and/or arranged offset, in particular angularly offset, with respect to each other in such a way that the supply or control of pressure to the sub-vane chambers via the sub-vane cavity of the first end-facing wall, and the supply or control of pressure to the sub-vane chambers via the opposite or similar sub-vane cavity of the second end-facing wall, differ from each other, for example in such a way that once the rotor has been rotated further in the rotational direction, a sub-vane chamber which had been fluidically connected to both sub-vane cavities is still fluidically connected to one sub-vane cavity but already fluidically separated from the other sub-vane cavity. Due to the sub-vane cavities in accordance with an aspect of the invention, it is for example possible to switch, in particular within an ascending or descending region, between supplying pressure to a sub-vane chamber axially on both sides and supplying pressure to a sub-vane chamber axially on one side. It is possible to realise an angle-dependent, axially asymmetrical supply of pressure to a sub-vane chamber.

Similar control edges can be control edges which perform the same function of the axially opposite or similar sub-vane cavities, such as for example each defining or forming the end or beginning of the sub-vane cavity, for example the first ascending sub-vane cavity, the first descending sub-vane cavity, the second ascending sub-vane cavity or the second descending sub-vane cavity of the end-facing walls. If, for example, the similar control edges each form an end of their sub-vane cavity, then the sub-vane cavity of the first end-facing wall can end earlier or later, as viewed in the rotational direction, than the opposite or similar sub-vane cavity of the second end-facing wall, whereby the supply of pressure to a sub-vane chamber via the sub-vane cavity of the first end-facing wall ends earlier or later than the supply of pressure to the sub-vane chamber via the sub-vane cavity of the second end-facing wall. If, for example, the similar control edges each form a beginning of their sub-vane cavity, then the sub-vane cavity of the first end-facing wall can begin earlier or later, as viewed in the rotational direction, than the opposite or similar sub-vane cavity of the second end-facing wall, whereby the supply of pressure to a sub-vane chamber via the sub-vane cavity of the first end-facing wall begins earlier or later than the supply of pressure to the sub-vane chamber via the sub-vane cavity of the second end-facing wall.

The control edges can differ from each other in their shape, for example: acute angle versus obtuse angle, kinked/bent inwards versus kinked/bent outwards, arc versus straight, ramp rising radially inwards versus ramp descending radially outwards. The similar control edges can also differ from each other in their extent, for example with regard to their width, depth, length. The control edges can be offset with respect to each other in the radial direction and/or in the circumferential direction.

The angular offset or angular distance between two similar control edges is advantageously measured in the projection between a first straight line (limb), which in the projection along the rotational axis forms a tangent onto one control edge and intersects the rotational axis, and a second straight line (limb) which in the projection along the rotational axis forms a tangent onto the other (similar) control edge and intersects the rotational axis, wherein the rotational axis forms the apex of the angle. The angular offset or angular distance between two similar control edges is preferably greater than 5°, advantageously greater than 10° and particularly advantageously greater than 15°.

Accordingly, the control edge of the sub-vane cavity of the first end-facing wall and the similar control edge of the sub-vane cavity of the second end-facing wall can be angularly offset about the rotational axis of the rotor as the apex.

Preferably, the control edge of the sub-vane cavity of the first end-facing wall, and the control edge of the opposite or similar sub-vane cavity of the second end-facing wall which is similar to it, are arranged such that they are offset with respect to each other by at least a width, aligned in the rotational direction, of the sub-vane chamber opening which points towards the end-facing wall. The angular offset or angular distance between two similar control edges preferably measures at least a width, aligned in the rotational direction, of the sub-vane chamber opening which points towards the end-facing wall. It is thus possible to realise a scenario in which at least one of the sub-vane chambers is connected in fluid communication with a sub-vane cavity of one end-facing wall and simultaneously is fluidically separated from the opposite or similar sub-vane cavity of the other end-facing wall, and is thus preferably supplied with pressure by one of the opposite or similar sub-vane cavities only, in at least one rotational position of the rotor. Pressure is thus advantageously supplied to this sub-vane chamber axially on one side only.

Due to the offset similar control edges, the rotor exhibits an angular position in which a sub-vane cavity of the first end-facing wall, for example the first descending sub-vane cavity of the first end-facing wall, is fluidically separated from a sub-vane chamber, and the opposite or similar sub-vane cavity of the second end-facing wall, for example the first descending sub-vane cavity of the second end-facing wall, is connected in fluid communication with said sub-vane chamber.

The rotor can advantageously assume a first rotational position, in which the sub-vane cavity of the first end-facing wall is connected in fluid communication with one of the sub-vane chambers and the opposite or similar sub-vane cavity of the second end-facing wall is likewise connected in fluid communication with said sub-vane chamber, and a second rotational position which is different from the first rotational position and in which the sub-vane cavity of the first end-facing wall is fluidically separated from one of the sub-vane chambers and the opposite or similar sub-vane cavity of the second end-facing wall is connected in fluid communication with said sub-vane chamber. As an alternative to or in addition to the second rotational position, the rotor can assume a third rotational position which is different from the first and/or second rotational position and in which the sub-vane cavity of the second end-facing wall is fluidically separated from one of the sub-vane chambers and the opposite or similar sub-vane cavity of the first end-facing wall is connected in fluid communication with said sub-vane chamber.

In particular, due to the offset between the similar control edges, the angular distance around the rotational axis of the rotor between a dead centre and the control edge of the sub-vane cavity of the first end-facing wall adjacent to the dead centre, and the angular distance around the rotational axis of the rotor between a dead centre and the similar control edge of the opposite or similar sub-vane cavity of the second end-facing wall adjacent to the dead centre, are preferably different in size.

Preferably, the rotor can assume a rotational position in which the sub-vane cavity of the first end-facing wall and the opposite or similar sub-vane cavity of the second end-facing wall are connected in fluid communication with the same sub-vane chamber when the vane assigned to it is situated in the first descending region or the second ascending region, and can assume a rotational position, in particular once it has been rotated further in the rotational direction, in which the sub-vane cavity of the first end-facing wall is fluidically separated from a sub-vane chamber and the opposite or similar sub-vane cavity of the second end-facing wall is connected in fluid communication with said sub-vane chamber when the vane assigned to it is situated in the first descending region or the second ascending region.

The vane cell pump is preferably adapted such that while the rotor is being rotated, a sub-vane chamber is connected in fluid communication with the sub-vane cavity, in particular the first descending sub-vane cavity, of one end-facing wall, in particular the second end-facing wall, until said sub-vane chamber is or comes to be connected in fluid communication with the sub-vane cavity, in particular the second ascending sub-vane cavity, of the other end-facing wall, in particular the first end-facing wall.

The rotor can advantageously assume a rotational position in which at least one of the sub-vane chambers

- is fluidically separated from a sub-vane cavity, in particular the first descending sub-vane cavity, of one end-facing wall, in particular the first end-facing wall, but is connected in fluid communication with the opposite or similar sub-vane cavity, in particular the first descending sub-vane cavity, of the other end-facing wall, in particular the second end-facing wall, and simultaneously
- is connected in fluid communication with a sub-vane cavity, in particular the second ascending sub-vane cavity, of said one end-facing wall, in particular the first end-facing wall, but is fluidically separated from the opposite or similar sub-vane cavity, in particular the second ascending sub-vane cavity, of the other end-facing wall, in particular the second end-facing wall.

The sub-vane chamber of a vane which is passing through the dead centre or constant region, in particular the lower dead centre or constant region, is preferably still connected to the sub-vane cavity, in particular the first descending sub-vane cavity, of one end-facing wall, in particular the second end-facing wall, but preferably already fluidically separated from the sub-vane cavity, in particular the first descending sub-vane cavity, of the other end-facing wall, in particular the first end-facing wall, and already connected in fluid communication with the sub-vane cavity, in particular the second ascending sub-vane cavity, of the other end-facing wall, in particular the first end-facing wall, but preferably still fluidically separated from the sub-vane cavity, in particular the second ascending sub-vane cavity, of said one end-facing wall, in particular the second end-facing wall, when said vane is situated on or in the constant region, in particular the lower constant region, or at its dead centre.

A second aspect of the invention relates to a vane cell pump comprising:

- a rotor, which can be rotated about a rotational axis, and a plurality of vanes which are guided by the rotor such that they can be shifted, wherein the rotor comprises a sub-vane chamber for each vane, and each vane forms a shifting wall of the sub-vane chamber assigned to it;
- a contour ring comprising an inner contour which extends around the rotational axis and along which the vanes slide when the rotor is rotated, wherein the inner contour of the contour ring is adapted to define at least one ascending region, for example a first ascending region and a second ascending region, and at least one descending region, for example a first descending region and a second descending region, wherein the vane is moved out of the rotor as it slides over the ascending region and is moved into the rotor as it slides over the descending region, wherein the end-facing wall, in particular the first end-facing wall, and another end-facing wall, in particular the second end-facing wall, each comprise:

at least one ascending sub-vane cavity, for example a first ascending sub-vane cavity and a second ascending sub-vane cavity, in fluid communication with which a sub-vane chamber is connected when its vane is situated in the ascending region of the contour ring;

at least one descending sub-vane cavity, for example a first descending sub-vane cavity and a second descending sub-vane cavity, in fluid communication with which a sub-vane chamber is connected when its vane is situated in the descending region of the contour ring;

a separating stay which is formed between the descending sub-vane cavity and the ascending sub-vane cavity, for example a separating stay which is formed between the first descending sub-vane cavity and the second ascending sub-vane cavity and/or a separating stay which is formed between the second descending sub-vane cavity and the first ascending sub-vane cavity, wherein a separating stay which is formed between the descending sub-vane cavity and the ascending sub-vane cavity of one end-facing wall is arranged such that it is angularly offset, about the rotational axis of the rotor as the apex, with respect to a separating stay which is an opposite separating stay as viewed along the separating stay or parallel to the rotational axis and which is formed between the descending sub-vane cavity and the ascending sub-vane cavity of the other end-facing wall.

The angular offset between two separating stays is advantageously measured in the projection along the rotational axis, i.e. parallel to the rotational axis, between a straight line (limb) through the midpoint of one separating stay, which line intersects the rotational axis of the rotor, and a straight line (limb) through the midpoint of the other (opposite or similar) separating stay, which line intersects the rotational axis of the rotor, wherein the rotational axis forms the apex of the angle. The midpoint of a separating stay preferably lies on the angle bisector of the angular distance around the rotational axis of the rotor as the apex between the control edges which delineate the separating stay in the rotational direction of the rotor. The angular offset between two opposite or similar separating stays is preferably greater than 5°, advantageously greater than 10° and particularly advantageously greater than 15°.

The separating stay of the first end-facing wall and the similar or opposite separating stay of the second end-facing wall can for example overlap in the projection along the rotational axis, preferably partially and in particular only partially and not completely, in particular in an overlap region.

The width, extending in the circumferential direction, of the overlap region is advantageously smaller than the width, extending in the circumferential direction, of the sub-vane chamber opening which points towards the first end-facing side and/or the sub-vane chamber opening which points towards the second end-facing side. It is thus possible to realise a scenario in which the sub-vane chamber of a vane which is passing through the overlap region is preferably still connected in fluid communication with a sub-vane cavity, in particular a first descending sub-vane cavity, of one end-facing wall, in particular the second end-facing wall, and is already connected in fluid communication with the sub-vane cavity, in particular the second ascending sub-vane cavity, of the other end-facing wall, in particular the first end-facing wall, when said vane is situated on or in the overlap region.

The constant region, in particular the lower constant region, is advantageously arranged within the angular range of the separating stay of the first end-facing wall and/or within the angular range of the separating stay of the second end-facing wall and in particular within the angular range of the overlap region.

The separating stay of the first end-facing wall and/or the separating stay of the second end-facing wall preferably exhibits a width, extending in the circumferential direction, which is greater than the width, extending in the circumferential direction, of the sub-vane chamber opening which points towards the first end-facing side and/or the sub-vane chamber opening which points towards the second end-facing side. It is thus possible to realise a scenario in which the relevant separating stay can completely seal the sub-vane chamber opening which points towards the end-facing wall, in a rotational position of the rotor, and/or a scenario in which the rotor exhibits or can assume a rotational position in which at least one of the sub-vane chambers is fluidically separated from the two sub-vane cavities of an end-facing wall which are adjacent in the circumferential direction.

A third aspect of the invention relates to a vane cell pump comprising:

a rotor and a plurality of vanes which are guided by the rotor such that they can be shifted, wherein the rotor comprises a sub-vane chamber for each vane, and each vane forms a shifting wall of the sub-vane chamber assigned to it;

a contour ring comprising an inner contour which extends around the rotational axis of the rotor and along which the vanes slide when the rotor is rotated, wherein the inner contour of the contour ring is adapted to define at least one ascending region and at least one descending region, wherein a vane is moved out of the rotor as it slides over the ascending region and is moved into the rotor as it slides over the descending region;

an end-facing wall, in particular a first or second end-facing wall, which adjoins the rotor on an end-facing side and which, in order to supply or control pressure to the sub-vane chamber, comprises a sub-vane cavity, in particular a first descending sub-vane cavity, which extends in the circumferential direction and comprises a control edge which forms an end of the first sub-vane cavity in the rotational direction, and another sub-vane cavity, in particular a second ascending sub-vane cavity, which extends in the circumferential direction and comprises a control edge which forms a beginning of said other sub-vane cavity in the rotational direction of the rotor, wherein the inner contour between the descending region and the ascending region comprises a constant region or a region which is adapted to define a dead centre, in particular an upper or lower dead centre, for the vane which is sliding over said region, wherein the angular distance around the rotational axis of the rotor as the apex between the region, in particular a midpoint or the dead centre of the region, and the control edge of one sub-vane cavity, and the angular distance between the region, in particular the midpoint or the dead centre of the region, and the control edge of the other sub-vane cavity, are different in size.

The angular distance around the rotational axis of the rotor as the apex between a control edge and a constant region or a region which defines an upper or lower dead centre for a vane is advantageously measured in a projection along the rotational axis, i.e. parallel to the rotational axis, between a straight line (limb), which intersects the rotational axis and forms a tangent onto the control edge in the projection along the rotational axis, and a straight line through the midpoint—in relation to the encircling direction of the rotor, the midpoint between the beginning and the end of the constant region—or the dead centre of the constant region or region which defines the dead centre for the vane. The midpoint or dead centre of the region or constant region preferably lies on an angle bisector of the angular distance around the rotational axis as the apex between the beginning and the end of the region or constant region. The midpoint of the region preferably forms the dead centre of the region, and/or the dead centre of the region preferably forms the midpoint of the region.

The angular distance between the region, preferably the lower region, in particular the midpoint or dead centre of the region, and the control edge of the sub-vane cavity, in particular the first descending sub-vane cavity, of one end-facing wall, in particular the second end-facing wall, is preferably smaller than the angular distance between the region, in particular the midpoint or dead centre of the region, and the control edge of the sub-vane cavity, in particular the second ascending sub-vane cavity, of said end-facing wall, in particular the second end-facing wall, and the angular distance between the region, in particular the midpoint or dead centre of the region, and the control edge of the sub-vane cavity, in particular the first descending sub-vane cavity, of the other end-facing wall, in particular the first end-facing wall, is preferably greater than the angular distance between the region, in particular the midpoint or dead centre of the region, and the control edge of the sub-vane cavity, in particular the second ascending sub-vane cavity, of said end-facing wall, in particular the first end-facing wall.

The angular distance between the region, preferably the lower region, in particular the midpoint or dead centre of the region, and the control edge of the sub-vane cavity, in particular the first descending sub-vane cavity, of one end-facing wall, in particular the first end-facing wall, is preferably greater than, equal to or smaller than the angular distance between the region, in particular the midpoint or dead centre of the region, and the control edge of the sub-vane cavity, in particular the first descending sub-vane cavity, of the other end-facing wall, in particular the second end-facing wall.

The angular distance between the region, preferably the lower region, in particular the midpoint or dead centre of the region, and the control edge of the sub-vane cavity, in particular the second ascending sub-vane cavity, of one end-facing wall, in particular the first end-facing wall, is preferably greater than, equal to or smaller than the angular distance between the region, in particular the midpoint or dead centre of the region, and the control edge of the sub-vane cavity, in particular the second ascending sub-vane cavity, of the other end-facing wall, in particular the second end-facing wall.

The angular distance between the region, preferably the lower region, in particular the midpoint or dead centre of the region, and the control edge of the sub-vane cavity, in particular the first descending sub-vane cavity, of one end-facing wall, in particular the first end-facing wall, is preferably greater than, equal to or smaller than the angular distance between the region, in particular the midpoint or dead centre of the region, and the control edge of the sub-vane cavity, in particular the second ascending sub-vane cavity, of the other end-facing wall, in particular the second end-facing wall.

In a multi-flux or multi-stroke vane cell pump in particular, the constant region, in particular the lower constant region, extends asymmetrically into two adjacent fluxes, i.e. in particular such that the constant region is arranged in a first flux and a second flux which is adjacent to the first flux, wherein its circumferential extent in one flux is greater than its circumferential extent in the other flux.

A fourth aspect of the invention relates to a vane cell pump comprising:

a rotor and a plurality of vanes which are guided by the rotor such that they can be shifted, wherein the rotor comprises a sub-vane chamber for each vane, and each vane forms a shifting wall of the sub-vane chamber assigned to it;

a contour ring comprising an inner contour which extends around the rotational axis of the rotor and along which the vanes slide when the rotor is rotated, wherein the inner contour of the contour ring is adapted to define at least one ascending region and at least one descending region, wherein a vane is moved out of the rotor as it slides over the ascending region and is moved into the rotor as it slides over the descending region;

an end-facing wall, in particular a first or second end-facing wall, which adjoins the rotor on an end-facing side and which, in order to supply or control pressure to the sub-vane chamber, comprises a sub-vane cavity, in particular a first descending sub-vane cavity, which extends in the circumferential direction and comprises a control edge which forms an end of the first sub-vane cavity in the rotational direction, and another sub-vane cavity, in particular a second ascending sub-vane cavity, which extends in the circumferential direction and comprises a control edge which forms a beginning of said other sub-vane cavity in the rotational direction of the rotor, wherein a separating stay is formed between the control edges, wherein the inner contour between the descending region and the ascending region comprises a constant region or a region which is adapted to define, in relation to the movement relative to the rotor, a dead centre, in particular an upper or lower dead centre, for the vane which is sliding over said region, wherein the separating stay, in particular a midpoint of the separating stay which is formed between the control edges in the encircling direction of the rotor, is angularly offset, about the rotational axis as the apex, with respect to the region or constant region, in particular a midpoint or the dead centre of the region or constant region.

The angular offset or angular distance between a separating stay and a constant region or region which defines an upper or lower dead centre for a vane is advantageously measured in the projection along the rotational axis of the rotor between a straight line (limb), which intersects the rotational axis, through the midpoint—in relation to the encircling direction of the rotor, the midpoint between the beginning and the end—of the separating stay and a straight line (limb), which intersects the rotational axis, through the midpoint—in relation to the encircling direction of the rotor, the midpoint between the beginning and the end—of the constant region or region which defines the dead centre for the vane, or the dead centre. The midpoint or dead centre of the region or constant region preferably lies on an angle bisector of the angular distance around the rotational axis as the apex between the beginning and the end of the region or constant region. The midpoint of the separating stay preferably lies on an angle bisector of the angular distance around the rotational axis as the apex between the beginning and the end of the separating stay. The midpoint of the region preferably forms the dead centre of the region, and/or the dead centre of the region preferably forms the midpoint of the region.

Preferably, the midpoint of the separating stay is angularly offset, about the rotational axis as the apex, with respect to the midpoint or dead centre, in particular the lower dead centre, of the region or in particular the lower constant region.

In a multi-flux or multi-stroke vane cell pump in particular, the separating stay of an end-facing wall can extend asymmetrically into two adjacent fluxes, i.e. in particular such that the separating stay of the end-facing wall is arranged in a first flux and a second flux which is adjacent to the first flux, wherein its circumferential extent in one flux is greater than its circumferential extent in the other flux.

A fifth aspect of the invention relates to a vane cell pump, which is for example formed as a dual-flux or two-stroke vane cell pump, comprising:

a rotor and a plurality of vanes which are guided by the rotor such that they can be shifted, wherein the rotor comprises a sub-vane chamber for each vane, and each vane forms a shifting wall of the sub-vane chamber assigned to it;

a contour ring comprising an inner contour which extends around the rotational axis of the rotor and along which the vanes slide when the rotor is rotated, wherein the inner contour of the contour ring is adapted to define a first ascending region and a first descending region which are assigned to a first flux, and a second ascending region and a second descending region which are assigned to the second flux, wherein a vane is moved out of the rotor as it slides over the ascending region and is moved into the rotor as it slides over the descending region, wherein the end-facing wall, in particular one of a first end-facing wall and a second end-facing wall, or the end-facing wall and another end-facing wall, each comprise:

a first ascending sub-vane cavity, in fluid communication with which a sub-vane chamber is connected when its vane is situated in the first ascending region of the contour ring;

a first descending sub-vane cavity, in fluid communication with which a sub-vane chamber is connected when its vane is situated in the first descending region of the contour ring;

a second ascending sub-vane cavity, in fluid communication with which a sub-vane chamber is connected when its vane is situated in the second ascending region of the contour ring;

a second descending sub-vane cavity, in fluid communication with which a sub-vane chamber is connected when its vane is situated in the second descending region of the contour ring;

a separating stay which is formed between the first descending sub-vane cavity and the second ascending sub-vane cavity; and a separating stay which is formed between the second descending sub-vane cavity and the first ascending sub-vane cavity, wherein the separating stays are offset, about the rotational axis as the apex, with respect to each other by an angle which is not equal to 180°.

The angular offset between two separating stays is advantageously measured in the projection along the rotational axis between a straight line (limb) through the midpoint of one separating stay, which line intersects the rotational axis of the rotor, and a straight line (limb) through the midpoint of the other separating stay, which line intersects the rotational axis of the rotor, wherein the rotational axis forms the apex of the angle. The midpoint of a separating stay preferably lies on the angle bisector of the angular distance around the rotational axis of the rotor as the apex between the control edges which delineate the separating stay in the rotational direction of the rotor.

The word "fluidically" is to be understood to mean "in relation to fluid communication". When two components are fluidically connected, this means that they are connected in fluid communication. When two components are fluidically separated or unconnected, this means that they are not connected in relation to fluid communication.

DRAWINGS

Figure 2:
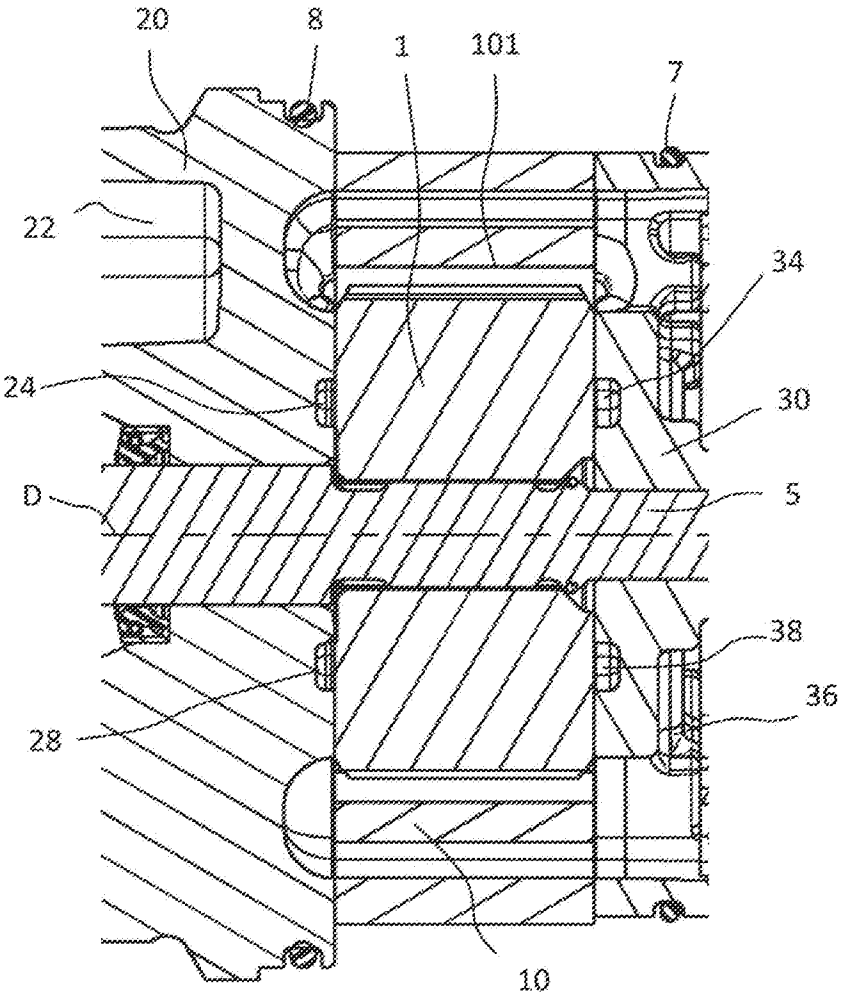
Figure 4:
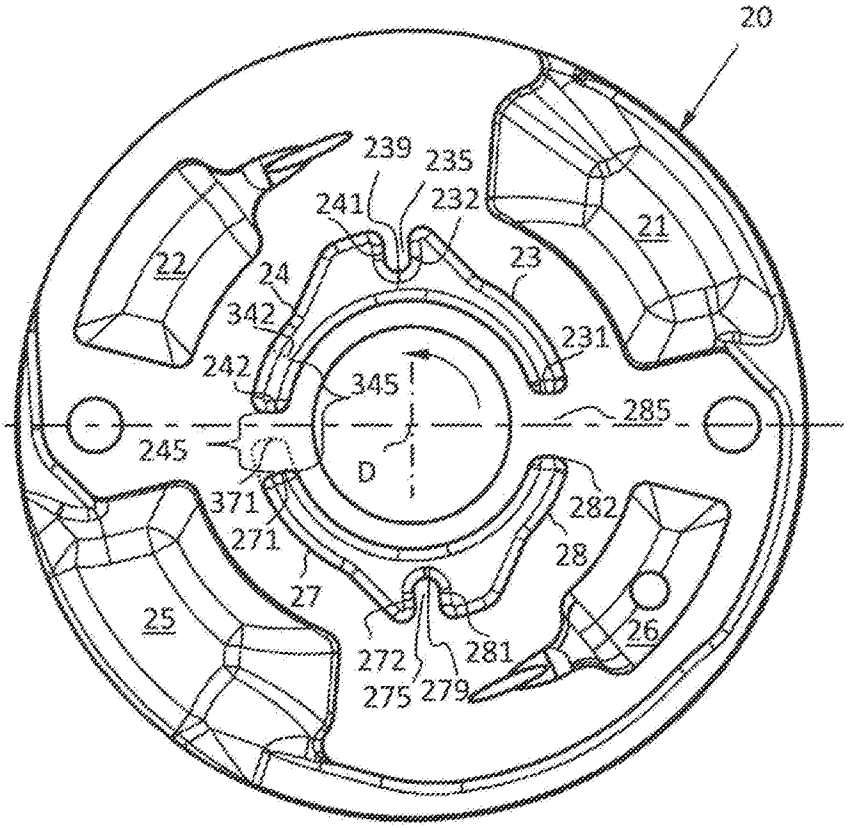
Figure 3:
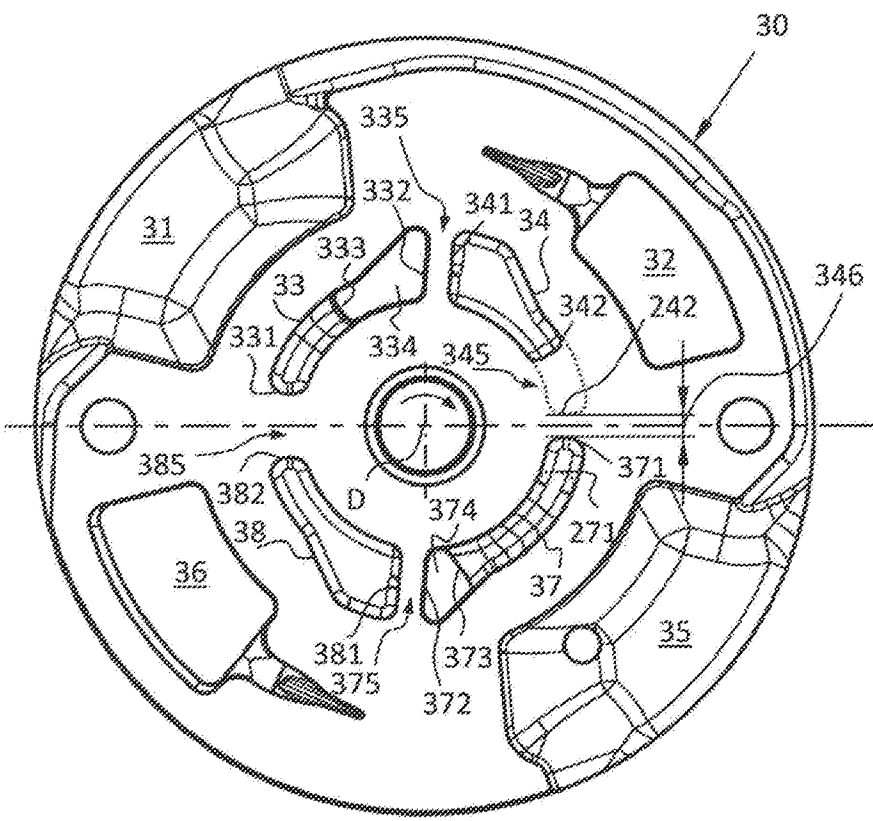

An aspect of the invention has been described on the basis of a number of embodiments and aspects. In the following, a preferred embodiment of the invention is described. The features thus disclosed, individually and in any combination of features, advantageously develop the subject-matter of the invention. There is shown:

FIG. 1 a plan view onto a vane cell pump, having a plane of projection which is perpendicular to a rotational axis of a rotor, with the second end-facing wall removed;

FIG. 2 a section along the rotational axis of the vane cell pump from FIG. 1;

FIG. 3 a plan view from the left onto a first end-facing wall of the vane cell pump from FIG. 2, having a plane of projection which is perpendicular to the rotational axis of the rotor; and FIG. 4 a plan view from the right onto a second end-facing wall of the vane cell pump from FIG. 2, having a plane of projection which is perpendicular to the rotational axis of the rotor.

DETAILED DESCRIPTION OF THE INVENTION

The example of a displacement pump which is shown in the figures is embodied as a vane cell pump. The vane cell pump comprises a rotor 1 which is for example non-rotationally connected to a pump shaft 5 via a shaft-hub connection. The rotor 1 is surrounded on its outer circumferential side by a contour ring 10 which is often also referred to as a stroke ring. A first end-facing wall 30 which is for example formed by a first housing part, in particular a side plate, adjoins the rotor 1 on an end-facing side on a first side of the rotor 1, and a second end-facing wall 20 which is for example formed by a second housing part, in particular a pressure plate, adjoins the rotor 1 on an end-facing side on a second side of the rotor 1. The rotor 1 is enclosed between the first end-facing wall 30 and the second end-facing wall 20. The shaft 5 is rotatably mounted, for example by means of a rotary bearing, on the first end-facing wall 30, in particular the first housing part, and/or on the second end-facing wall 20, in particular the second housing part. The rotary bearing can for example be a roll bearing or a slide bearing. The rotor 1 can be rotated relative to the first end-facing wall 30, the second end-facing wall 20 and the contour ring 10. Rotational direction arrows in FIGS. 3 and 4 indicate the rotational direction of the rotor 1 during delivery operations, i.e. when it is delivering fluid from an inlet 31, 35, 21, 25 to an outlet 32, 36, 22, 26. The rotational direction arrows in FIGS. 3 and 4 point in opposite directions, since FIG. 3 shows the first end-facing wall 30 in a view from the left in relation to FIG. 2, and FIG. 4 shows the second end-facing wall 20 in a view from the right in relation to FIG. 2.

The contour ring 10 is enclosed between the first end-facing wall 30 and the second end-facing wall 20 and is non-rotational with respect to them. The space which extends annularly around the shaft 5 and which is surrounded by the inner circumference of the contour ring 10 and axially delineated by the first end-facing wall 30 and the second end-facing wall 20 can also be referred to as the pump chamber. The rotor 1 and vanes which are mounted by the rotor 1 are arranged in the pump chamber. In the example shown, the contour ring 10 is a part which is separate from the first housing part and the second housing part. The contour ring 10 can optionally be formed integrally with the first housing part or the second housing part.

In the example shown, a pump insert which can be inserted into an outer housing (not shown), for example a cup-shaped outer housing, is formed by the first end-facing wall 30, in particular the first housing part, and the second end-facing wall 20, in particular the second housing part, the contour ring 10 and the rotor 1 including the vanes 2 and optionally the shaft 5. The outer housing comprises at least an inner circumferential wall and an end-facing wall. A first gasket 7 and a second gasket 8 can be arranged between the pump insert and the inner circumference of the outer housing. The first gasket 7 can be arranged between the first housing part and the inner circumference of the outer housing. The first housing part can in particular comprise a recess which is circumferential over its outer circumference and in particular groove-shaped and in which the gasket 7, which is in particular annular (for example an O-ring), is seated. The second gasket 8 can be arranged between the second housing part and the inner circumference of the outer housing. The second housing part can in particular comprise a recess which is circumferential over its outer circumference and in particular groove-shaped and in which the gasket 8, which is in particular annular (for example an O-ring), is seated. A suction space, from which fluid is delivered to at least one pressure space via the pump chamber, can be formed between the first gasket 7 and the second gasket 8. The at least one pressure space can be arranged or formed between the end-facing wall of the outer housing and the first housing part 30.

The vane cell pump shown in the example is formed as a dual-flux vane cell pump, i.e. fluid can be delivered into the at least one pressure space via a first fluid path which passes through the pump chamber, and can be delivered into the at least one pressure space via a second fluid path which passes through the pump chamber and in particular separately from the first fluid path within the pump chamber. The at least one pressure space can be a common pressure space, into which fluid is delivered via the first fluid path and the second fluid path, or can comprise a first pressure space, into which fluid is delivered via the first fluid path, and a second pressure space into which fluid is delivered via the second fluid path. The first pressure space and the second pressure space can for example be sealed off with respect to each other by a gasket (not shown). The gasket can for example be arranged between the end-facing wall of the outer housing and the first housing part.

The first end-facing wall and/or the second end-facing wall, in particular the relevant housing part, can each comprise a cavity which is open towards the vanes 2 and which forms a first inlet 31, 21 which is assigned to the first fluid path and arranged between the suction space and the pump chamber and which connects the suction space and the pump chamber in fluid communication with each other. The first end-facing wall and/or the second end-facing wall, in particular the relevant housing part, can each comprise a cavity which is open towards the vanes 2 and which forms a first outlet 32, 22 which is assigned to the first fluid path and arranged between the at least one pressure space and the pump chamber and which connects the at least one pressure space and the pump chamber in fluid communication with each other. The first housing part 30 can comprise the cavity, in particular a channel, which forms the first outlet 32 and which is open towards the vanes 2 and towards the end-facing wall of the outer housing and/or feeds for example into the at least one pressure space. The inlets 31, 21 are each formed as a radially open recess in the respective end-facing wall 30, 20 and/or in the respective housing part. The inlets 31, 21 lie axially opposite each other. The outlet 32 is formed as an aperture in the first end-facing wall 30 and/or the first housing part. The outlet 22 is formed as a recess in the second end-facing wall 20 and/or the second housing part. The outlets 32, 22 lie axially opposite each other. The outlets 32, 22 are connected to each other via a channel 102 in the contour ring 10. The channel 102 is formed as an aperture in the contour ring 10.

The first end-facing wall and/or the second end-facing wall, in particular the relevant housing part, can each comprise a cavity which is open towards the vanes 2 and which forms a second inlet 35, 25 which is assigned to the second fluid path and arranged between the suction space and the pump chamber and which connects the suction space and the pump chamber in fluid communication with each other. The first end-facing wall and/or the second end-facing wall, in particular the relevant housing part, can each comprise a cavity which is open towards the vanes 2 and which forms a second outlet 36, 26 which is assigned to the second fluid path and arranged between the at least one pressure space and the pump chamber and which connects the at least one pressure space and the pump chamber in fluid communication with each other. The first housing part 30 can comprise the cavity, in particular a channel, which forms the second outlet 36 and is open towards the vanes 2 and towards the end-facing wall of the outer housing and/or feeds for example into the at least one pressure space. The inlets 35, 25 are each formed as a radially open recess in the respective end-facing wall 30, 20 and/or in the respective housing part. The inlets 35, 25 lie axially opposite each other. The outlet 36 is formed as an aperture in the first end-facing wall 30 and/or the first housing part. The outlet 26 is formed as a recess in the second end-facing wall 20 and/or the second housing part. The outlets 36, 26 lie axially opposite each other. The outlets 36, 26 are connected to each other via a channel 103 in the contour ring 10. The channel 103 is formed as an aperture in the contour ring 10.

As can best be seen from FIG. 1, a first delivery chamber which is assigned to the first fluid path, and a second delivery chamber which is assigned to the second fluid path, are formed radially between the rotor 1 and the contour ring 10.

The rotor 1 comprises cavities, in particular slot-shaped cavities, which serve as guides. Each of the cavities is assigned a delivery element, namely a vane 2. Each of the vanes 2 can be shifted radially or away from and towards the rotational axis R of the rotor 1 at its cavity, in particular shifted back and forth while being guided with one translational degree of freedom, as can be seen for example from FIG. 1. The vanes 2 are rotated along with the rotor 1. A delivery cell 4, the volume of which varies in accordance with the rotational position of the rotor 1 about its rotational axis R, is respectively formed between adjacent vanes 2. Since the pump comprises a plurality of vanes 2 which are distributed, in particular uniformly, over the circumference, it also comprises a corresponding number of delivery cells 4. A plurality of delivery cells 4 are situated in each of the two delivery chambers. The vanes 2 and the rotor 1 form a first sealing gap with the first end-facing wall 30 and a second sealing gap with the second end-facing wall 20.

The inner circumferential surface of the contour ring 10 comprises an inner contour 101 which causes the vanes 2 to be extended (increasing the volume of the delivery cell 4) at least once and retracted (decreasing the volume of the delivery cell 4) at least once during a complete revolution of the rotor 1. The vane cell pump shown in the example from the figures is formed as a twin-stroke vane cell pump, i.e. it comprises two delivery chambers, wherein the vanes 2 are extended once and retracted once, as they pass through a delivery chamber, when they are moved through the delivery chamber by means of rotating the rotor. This causes the vanes 2 to be extended, retracted, extended and retracted again, or in other words, extended twice and retracted twice, during a complete revolution of the rotor 1. A delivery cell 4 is respectively formed between adjacent vanes 2, wherein the volume of the delivery cell 4 is increased and/or decreased by extending and retracting the vanes 2 which delineate said delivery cell 4, i.e. in accordance with the inner contour 101 of the inner circumferential surface of the contour ring 10.

The rotor 1 respectively comprises a sub-vane chamber 3 for each vane 2. Each vane 2 forms a shifting wall of the sub-vane chamber 3 assigned to it. A slot-shaped cavity for guiding the relevant vane 2 is arranged between the outer circumference of the rotor 1 and each of the sub-vane chambers 3. The sub-vane chambers 3 can exhibit a greater width, extending in the circumferential direction, than the slot-shaped cavities which serve to guide the vanes 2. By selectively applying pressure to the relevant sub-vane chamber 3 and/or selectively relieving pressure on the relevant sub-vane chamber 3 using pressure fluid, a force which points away from the rotational axis R can be applied to the shifting wall of the vane 2 or the shifting wall can be relieved of this force. This force can optionally also be reduced. On the one hand, it is desirable to prevent the vanes 2 from lifting off the inner contour 101, in order to avoid losses due to a lack of seal; on the other hand, it is desirable to prevent the vanes 2 from being pressed too strongly onto the inner contour 101, in order to avoid wear due to friction and keep the energy consumption due to friction low.

Each of the sub-vane chambers 3 comprises a first opening, which feeds towards the first end-facing wall, and a second opening which feeds towards the second end-facing wall 20.

In order to supply or control pressure to the sub-vane chambers 3, the first end-facing wall 30 which is adjoining on an end-facing side on the first side of the rotor 1 comprises elongated sub-vane cavities 33, 34, 37, 38 (FIG. 3) which extend in the circumferential direction, in particular in a curve around the rotational axis R. The sub-vane cavities 33, 34, 37, 38 each form an arc portion encircling the rotational axis R and are arranged sequentially or in series in the encircling direction, such that each first opening of the sub-vane chambers 3 successively passes over each of the sub-vane cavities 33, 34, 37, 38 during a complete revolution of the rotor 1. While a first opening passes over one of the sub-vane cavities 33, 34, 37, 38, the sub-vane chamber 3 assigned to this opening is connected in fluid communication with said sub-vane cavity, whereby pressure can for example be applied to the sub-vane chamber 3 or the sub-vane chamber 3 can for example be relieved of pressure.

A separating stay 335, which separates the sub-vane cavity 33 and the sub-vane cavity 34 from each other, is formed between the sub-vane cavities 33 and 34 in the encircling direction around the rotational axis R. A separating stay 345, which separates the sub-vane cavity 34 and the sub-vane cavity 37 from each other, is formed between the sub-vane cavities 34 and 37 in the encircling direction around the rotational axis R. A separating stay 375, which separates the sub-vane cavity 37 and the sub-vane cavity 38 from each other, is formed between the sub-vane cavities 37 and 38 in the encircling direction around the rotational axis R. A separating stay 385, which separates the sub-vane cavity 38 and the sub-vane cavity 33 from each other, is formed between the sub-vane cavities 38 and 33 in the encircling direction around the rotational axis R.

In order to supply or control pressure to the sub-vane chambers 3, the second end-facing wall 20 which is adjoining on an end-facing side on the second side of the rotor 1 comprises elongated sub-vane cavities 23, 24, 27, 28 (FIG. 4) which extend in the circumferential direction, in particular in a curve around the rotational axis R. The sub-vane cavities 23, 24, 27, 28 each form an arc portion encircling the rotational axis R and are arranged sequentially or in series in the encircling direction, such that each second opening of the sub-vane chambers 3 successively passes over each of the sub-vane cavities 23, 24, 27, 28 during a complete revolution of the rotor 1. While a second opening passes over one of the sub-vane cavities 23, 24, 27, 28, the sub-vane chamber 3 assigned to this opening is connected in fluid communication with said sub-vane cavity, whereby pressure can for example be applied to the sub-vane chamber 3 or the sub-vane chamber 3 can for example be relieved of pressure.

A channel 239, in particular a groove-shaped channel 239, which is open towards the rotor is formed by the end-facing wall between the sub-vane cavity 23 and the sub-vane cavity 24 in the encircling direction around the rotational axis R, wherein the channel 239, as a hydraulic constriction, connects the sub-vane cavity 23 in fluid communication with the sub-vane cavity 24. The width and/or depth of the channel 239 is/are smaller than the width and/or depth of the end of the sub-vane cavity 23 and/or the sub-vane cavity 24 adjoining the channel 239. A flank of the channel 239 is formed by a protrusion 235 which extends from the outer flank of the sub-vane cavity 23 and the outer flank of the sub-vane cavity 24 towards the rotational axis R. Through the channel 239, a throttled exchange of fluid can occur between the cavities 23 and 24.

A channel 279, in particular a groove-shaped channel 279, which is open towards the rotor is formed by the end-facing wall between the sub-vane cavity 27 and the sub-vane cavity 28 in the encircling direction around the rotational axis R, wherein the channel 279, as a hydraulic constriction, connects the sub-vane cavity 27 in fluid communication with the sub-vane cavity 28. The width and/or depth of the channel 279 is/are smaller than the width and/or depth of the end of the sub-vane cavity 27 and/or the sub-vane cavity 28 adjoining the channel 279. A flank of the channel 279 is formed by a protrusion 275 which extends from the outer flank of the sub-vane cavity 27 and the outer flank of the sub-vane cavity 28 towards the rotational axis R. Through the channel 279, a throttled exchange of fluid can occur between the cavities 27 and 28.

The protrusion 235, 275 can be referred to as a separating stay which connects the adjacent sub-vane cavities to each other with throttle. Alternatively, the channels 239 and/or 279 can be omitted and a separating stay can instead be formed between the sub-vane cavities 23 and 24 and/or 27 and 28 in the encircling direction around the rotational axis R, wherein the separating stay fluidically separates the sub-vane cavities 23 and 24 and/or 27 and 28 from each other.

A separating stay 245 which separates the sub-vane cavity 24 and the sub-vane cavity 27 from each other, is arranged between the sub-vane cavities 24 and 27 in the encircling direction around the rotational axis R. A separating stay 285 which separates the sub-vane cavity 28 and the sub-vane cavity 23 from each other, is arranged between the sub-vane cavities 28 and 23 in the encircling direction around the rotational axis R.

During a complete revolution of the rotor 1, the first openings of the sub-vane chambers 3 pass not only over the sub-vane cavities 33, 34, 37, 38 but also over the separating stays 335, 345, 375, 385, and/or the second openings of the sub-vane chambers 3 pass not only over the sub-vane cavities 23, 24, 27, 28 but also over the separating stays 245, 285 and the channels 239, 279 and/or the protrusions 235, 275 or the separating stays (not shown) provided as an alternative to the channels and/or protrusions.

As can be seen from FIG. 3, the first housing part which forms the first end-facing wall 30 comprises a channel 334 which feeds into the sub-vane cavity 33. The channel 334 connects the pressure side, for example the first outlet 32 or the at least one pressure space or the first pressure space, in fluid communication with the sub-vane cavity 33. This supplies pressure fluid to the sub-vane cavity 33 and to the sub-vane chamber(s) 3 in which the first opening is situated in a position in which it at least partially overlaps the sub-vane cavity 33. The first housing part also comprises a channel 374 which feeds into the sub-vane cavity 37. The channel 374 connects the pressure side, for example the second outlet 36 or the at least one pressure space or the second pressure space, in fluid communication with the sub-vane cavity 37. This supplies pressure fluid to the sub-vane cavity 37 and to the sub-vane chamber(s) 3 in which the first opening is situated in a position in which it at least partially overlaps the sub-vane cavity 37.

In this example, the sub-vane cavities 34, 38 are closed off in relation to the suction side and the pressure side of the first end-facing wall 30, i.e. the first housing part does not comprise any channel which connects the pressure side or the suction side of the first end-facing wall 30 in fluid communication with the sub-vane cavities 34, 38. In one alternative embodiment, the channels 334, 374 can feed into the sub-vane cavities 34, 38, wherein the sub-vane cavities 33, 37 are closed off in relation to the suction side and the pressure side. In another alternative embodiment, the first housing part can form, in addition to the arrangement shown in FIG. 3, another channel which feeds into the sub-vane cavity 34 and connects the suction side or the pressure side in fluid communication with the sub-vane cavity 34, and yet another channel which feeds into the sub-vane cavity 38 and connects the suction side or the pressure side in fluid communication with the sub-vane cavity 38.

As can be seen from FIG. 4, the sub-vane cavities 23, 24 are closed off in relation to the suction side and the pressure side of the second end-facing wall 20, i.e. the second housing part does not comprise any channel which connects the pressure side or the suction side of the second end-facing wall 20 in fluid communication with the sub-vane cavities 23, 24. The same apples analogously to the sub-vane cavities 27, 28. Accordingly, the sub-vane cavities 27, 28 are closed off in relation to the suction side and the pressure side of the second end-facing wall 20, i.e. the second housing part does not comprise any channel which connects the pressure side or the suction side of the second end-facing wall 20 in fluid communication with the sub-vane cavities 27, 28.

Pressure fluid is supplied to the sub-vane cavity 23 of the second end-facing wall 20 by the sub-vane cavity 33 of the first end-facing wall 30 via the sub-vane chambers 3. The fluid flows axially through the sub-vane chambers 3 from the sub-vane cavity 33 of the first end-facing wall 30 into the sub-vane cavity 23 of the second end-facing wall 20. Pressure fluid is supplied to the sub-vane cavity 24 of the second end-facing wall 20 by the sub-vane cavity 23 of the second end-facing wall 20 via the channel 239. Pressure fluid is supplied to the sub-vane cavity 34 of the first end-facing wall 30 by the sub-vane cavity 24 of the second end-facing wall 20 via the sub-vane chambers 3. The fluid flows axially through the sub-vane chambers 3 from the sub-vane cavity 24 of the second end-facing wall 20 into the sub-vane cavity 34 of the first end-facing wall 30. This forces the fluid axially through the sub-vane chambers 3 and therefore through the rotor 1, thus improving the application, in particular the uniform application, of pressure to the vanes 2.

Pressure fluid is supplied to the sub-vane cavity 27 of the second end-facing wall 20 by the sub-vane cavity 37 of the first end-facing wall 30 via the sub-vane chambers 3. The fluid flows axially through the sub-vane chambers 3 from the sub-vane cavity 37 of the first end-facing wall 30 into the sub-vane cavity 27 of the second end-facing wall 20. Pressure fluid is supplied to the sub-vane cavity 28 of the second end-facing wall 20 by the sub-vane cavity 27 of the second end-facing wall 20 via the channel 279. Pressure fluid is supplied to the sub-vane cavity 38 of the first end-facing wall 30 by the sub-vane cavity 28 of the second end-facing wall 20 via the sub-vane chambers 3. The fluid flows axially through the sub-vane chambers 3 from the sub-vane cavity 28 of the second end-facing wall 20 into the sub-vane cavity 38 of the first end-facing wall 30. This forces the fluid axially through the sub-vane chambers 3 and therefore through the rotor 1, thus improving the application, in particular the uniform application, of pressure to the vanes 2.

The sub-vane cavities 33, 34, 37, 38, 23, 24, 27, 28 each comprise a control edge 331, 341, 371, 381, 231, 241, 271, 281 which, in relation to the rotating direction of the rotor 1, form a beginning of their respective sub-vane cavity 33, 34, 37, 38, 23, 24, 27, 28. Angularly offset in the rotating direction of the rotor 1, the sub-vane cavities 33, 34, 37, 38, 23, 24, 27, 28 each comprise a control edge 332, 342, 372, 382, 232, 242, 272, 282 which, in relation to the rotating direction of the rotor 1, form an end of their respective sub-vane cavity 33, 34, 37, 38, 23, 24, 27, 28. The control edges 241, 232 are formed by the protrusion 235, and the control edges 281, 272 are formed by the protrusion 275.

The sub-vane cavities 33, 34, 37, 38, 23, 24, 27, 28 each comprise a base which delineates the respective sub-vane cavity with regard to its depth along the rotational axis R. While the sub-vane cavities 34, 38, 23, 24, 27, 28 each comprise a continuous base, the base of the sub-vane cavities 33, 37 is interrupted by the channels 334, 374 which feed into the sub-vane cavities 33, 37. The transition 333 at which the base of the sub-vane cavity 33 transitions into a wall of the channel 334 is arranged angularly offset, in relation to the rotational axis R as the apex, with respect to the control edge 331 and the control edge 332 and in particular approximately arranged centrally, such as for example in the middle third, between the control edges 331, 332. The base of the sub-vane cavity 33 is formed between the control edge 331 and the transition 333. The transition 373 at which the base of the sub-vane cavity 37 transitions into a wall of the channel 374 is arranged angularly offset, in relation to the rotational axis R as the apex, with respect to the control edge 371 and the control edge 372, and in particular arranged nearer to the control edge 372 than to the control edge 371, in particular in the third of the sub-vane cavity 37 adjoining the control edge 372. The base of the sub-vane cavity 37 is formed between the control edge 371 and the transition 373.

The opening cross-section of the channel 334 and the opening cross-section of the channel 374 differ from each other. The opening cross-section of the channel 334 is larger than the opening cross-section of the channel 374. The channels 334, 374 are each formed as an aperture in the first end-facing wall 30 and/or first housing part.

The width, extending in the radial direction in relation to the rotational axis R, at the beginning of the sub-vane cavities 33, 37, 23, 27 is smaller than the width, extending in the radial direction in relation to the rotational axis R, at the end of the respective sub-vane cavity 33, 37, 23, 27. The width, extending in the radial direction in relation to the rotational axis R, at the beginning of the sub-vane cavities 34, 38, 24, 28 is greater than the width, extending in the radial direction in relation to the rotational axis R, at the end of the respective sub-vane cavity 34, 38, 24, 28.

As can be seen from FIG. 1, the contour ring 10 comprises the inner contour 101. The inner contour 101 comprises a first ascending region 11, a constant region 12, a first descending region 13, a constant region 14, a second ascending region 15, a constant region 16, a second descending region 17 and a constant region 18, which are passed through in that order by the vanes 2, which slide along the inner contour 101, during a complete revolution. When a vane 2 passes through the region 11 or 15, it is extended out of the rotor 1, for which reason these regions are referred to as ascending regions 11, 15. When a vane 2 passes through the region 13 or 17, it is retracted into the rotor 1, for which reason these regions are referred to as descending regions 13, 17. The ascending region 11 and the descending region 13 are assigned to the first fluid path and are therefore referred to as the first ascending region 11 and the first descending region 13. The ascending region 15 and the descending region 17 are assigned to the second fluid path and are therefore referred to as the second ascending region 15 and the second descending region 17.

When the vanes 2 pass through the ascending region 11, 15, the vanes 2 are extended, thus increasing the volume of the delivery cells 4 adjoining these vanes 2. When the vanes 2 pass through the descending region 13, 17, the vanes 2 are retracted, thus decreasing the volume of the delivery cells 4 adjoining these vanes 2.

The inlet 31 and/or 21 is arranged, in relation to the first ascending region 11 of the inner contour 101, such that the vane 2 which slides along the first ascending region 11 passes over the inlet 31 and/or 21, thus filling the delivery cell 4 adjoining the vane 2 with fluid from the inlet 31 and/or 21.

The sub-vane cavity 33 is arranged, in relation to the first ascending region 11 of the inner contour 101, such that the first opening of the sub-vane chamber 3, the assigned vane 2 of which is sliding along the first ascending region 11, at least partially overlaps with the sub-vane cavity 33, whereby the sub-vane cavity 33 is connected in fluid communication with the sub-vane chamber 3 when the assigned vane 2 is situated in the first ascending region 11 of the inner contour 101. Extending the vane 2 out of the rotor 1 can then be assisted by pressure fluid from the sub-vane cavity 33, and it is possible to ensure that the vane 2 abuts the inner contour 101.

The sub-vane cavity 23 is arranged, in relation to the first ascending region 11 of the inner contour 101, such that the second opening of the sub-vane chamber 3, the assigned vane 2 of which is sliding along the first ascending region 11, at least partially overlaps with the sub-vane cavity 23, whereby the sub-vane cavity 23 is connected in fluid communication with the sub-vane chamber 3 when the assigned vane 2 is situated in the first ascending region 11 of the inner contour 101. Extending the vane 2 out of the rotor 1 can then be assisted by fluid from the sub-vane cavity 23, wherein the sub-vane cavity 24 is supplied with fluid from the sub-vane cavity 23 via the channel 239. It is also then possible to ensure that the vane 2 abuts the inner contour 101. The sub-vane cavity 23 is in turn supplied with fluid from at least one of the sub-vane chambers 3, as described further below.

Given the interaction between the sub-vane chamber 3, the assigned vane 2 of which is passing through the first ascending region 11, and the sub-vane cavities 33, 23, the latter can be referred to as first ascending sub-vane cavities 23, 33.

The outlet 32 and optionally the recess 22 formed by the second end-facing wall 20 are arranged, in relation to the first descending region 13 of the inner contour 101, such that the vane 2 which slides along the first descending region 13 passes over the outlet 32 and/or the recess 22, thus emptying the delivery cell 4 adjoining the vane 2 into the outlet 32 and optionally into the recess 22.

The sub-vane cavity 34 is arranged, in relation to the first descending region 13 of the inner contour 101, such that the first opening of the sub-vane chamber 3, the assigned vane 2 of which is sliding along the first descending region 13, at least partially overlaps with the sub-vane cavity 34, whereby the sub-vane cavity 34 is connected in fluid communication with the sub-vane chamber 3 when the assigned vane 2 is situated in the first descending region 13 of the inner contour 101. It is then possible to ensure that the vane 2 abuts the inner contour 101 even when being retracted.

The sub-vane cavity 24 is arranged, in relation to the first descending region 13 of the inner contour 101, such that the second opening of the sub-vane chamber 3, the assigned vane 2 of which is sliding along the first descending region 13, at least partially overlaps with the sub-vane cavity 24, whereby the sub-vane cavity 24 is connected in fluid communication with the sub-vane chamber 3 when the assigned vane 2 is situated in the first descending region 13 of the inner contour 101. As described further above, the fluid dispensed from the sub-vane chamber 3 into the sub-vane cavity 23 flows through the channel 239 into the sub-vane cavity 24 and through the sub-vane chambers 3 from the sub-vane cavity 24 into the sub-vane cavity 34. The at least one sub-vane chamber 3, the first opening of which at least partially overlaps with the sub-vane cavity 34 and/or the second opening of which at least partially overlaps with the sub-vane cavity 24, is then supplied with fluid.

Given the interaction between the sub-vane chamber 3, in which the vane 2 is passing through the first descending region 13, and the sub-vane cavities 34, 24, the latter can be referred to as first descending sub-vane cavities 24, 34.

The inlet 35 and/or 25 is arranged, in relation to the second ascending region 15 of the inner contour 101, such that the vane 2 which slides along the second ascending region 15 passes over the inlet 35 and/or 25, thus filling the delivery cell 4 adjoining the vane 2 with fluid from the inlet 35 and/or 25. The sub-vane cavity 37 is arranged, in relation to the second ascending region 15 of the inner contour 101, such that the first opening of the sub-vane chamber 3, the assigned vane 2 of which is sliding along the second ascending region 15, at least partially overlaps with the sub-vane cavity 37, whereby the sub-vane cavity 37 is connected in fluid communication with the sub-vane chamber 3 when the assigned vane 2 is situated in the second ascending region 15 of the inner contour 101. Extending the vane 2 out of the rotor 1 can then be assisted by pressure fluid from the sub-vane cavity 37. The sub-vane cavity 27 is arranged, in relation to the second ascending region 15 of the inner contour 101, such that the second opening of the sub-vane chamber 3, the assigned vane 2 of which is sliding along the second ascending region 15, at least partially overlaps with the sub-vane cavity 27, whereby the sub-vane cavity 27 is connected in fluid communication with the sub-vane chamber 3 when the assigned vane 2 is situated in the second ascending region 15 of the inner contour 101. Extending the vane 2 out of the rotor 1 can then be assisted by fluid from the sub-vane cavity 27, wherein the sub-vane cavity 28 is supplied with fluid from the sub-vane cavity 27 via the channel 279. The sub-vane cavity 27 is in turn supplied with fluid from at least one of the sub-vane chambers 3, as described further below.

Given the interaction between the sub-vane chamber 3, in which the vane 2 is passing through the second ascending region 15, and the sub-vane cavities 37, 27, the latter can be referred to as second ascending sub-vane cavities 27, 37.

The outlet 36 and optionally the recess 26 formed by the second end-facing wall 20 are arranged, in relation to the second descending region 17 of the inner contour 101, such that the vane 2 which slides along the second descending region 17 passes over the outlet 36 and/or the recess 26, thus emptying the delivery cell 4 adjoining the vane 2 into the outlet 36 and optionally into the recess 26. The sub-vane cavity 38 is arranged, in relation to the second descending region 17 of the inner contour 101, such that the first opening of the sub-vane chamber 3, the assigned vane 2 of which is sliding along the second descending region 17, at least partially overlaps with the sub-vane cavity 38, whereby the sub-vane cavity 38 is connected in fluid communication with the sub-vane chamber 3 when the assigned vane 2 is situated in the second descending region 17 of the inner contour 101.

The sub-vane cavity 28 is arranged, in relation to the second descending region 17 of the inner contour 101, such that the second opening of the sub-vane chamber 3, the assigned vane 2 of which is sliding along the second descending region 17, at least partially overlaps with the sub-vane cavity 28, whereby the sub-vane cavity 28 is connected in fluid communication with the sub-vane chamber 3 when the assigned vane 2 is situated in the second descending region 17 of the inner contour 101. As described further above, the fluid dispensed from the sub-vane chamber 3 into the sub-vane cavity 27 flows through the channel 279 into the sub-vane cavity 28 and through the sub-vane chambers 3 from the sub-vane cavity 28 into the sub-vane cavity 38. The at least one sub-vane chamber 3, the first opening of which at least partially overlaps with the sub-vane cavity 38 and/or the second opening of which at least partially overlaps with the sub-vane cavity 28, is then supplied with fluid.

Given the interaction between the sub-vane chamber 3, in which the vane 2 is passing through the second descending region 17, and the sub-vane cavities 38, 28, the latter can be referred to as second descending sub-vane cavities 28, 38.

The inner contour 101 forms a constant region 12 between the first ascending region 11 and the first descending region 13 and forms a constant region 16 between the second ascending region 15 and the second descending region 17. The inner contour 101 forms a constant region 14 between the first descending region 13 and the second ascending region 15 and forms a constant region 18 between the second descending region 17 and the first ascending region 11. The constant regions 12, 14, 16, 18 are formed such that when the vanes 2 are moving through the constant region, they are stationary, i.e. not being retracted or extended, in relation to the rotor 1. The inner contour 101 can for example exhibit the shape of a circular arc, about the rotational axis R as the midpoint, in the constant regions.

When a vane 2 passes through the constant region 12 and/or 16, it assumes an upper dead centre at which its direction of movement in relation to the rotor is reversed. The constant regions 12 and/or 16 can therefore be referred to as upper constant regions 12, 16. Since the upper constant region 12 is assigned to the first flux, it can be referred to as the first upper constant region. Since the upper constant region 16 is assigned to the second flux, it can be referred to as the second upper constant region. When a vane passes through the constant region 14 and/or 18, it assumes a lower dead centre at which its direction of movement in relation to the rotor 1 is reversed. The constant regions 14 and/or 18 can therefore be referred to as lower constant regions 14, 18. The constant regions 14, 18 separate the first flux and the second flux from each other and are therefore not assigned to any specific flux and/or are assigned exclusively to one of the fluxes.

In the example shown in FIG. 1, the angular distance between two adjacent vanes 2 is smaller than the angular distance between the beginning and the end of the constant region 12, 14, 16, 18. In other words, the rotor 1 can be rotated, in relation to the contour ring 10, into one or more positions in which a delivery cell 4 is situated completely within one of the constant regions 12, 14, 16, 18. In the example shown in FIG. 1, the rotor 1 can even be rotated, in relation to the contour ring 10, into one or more positions in which a delivery cell 4 is respectively situated simultaneously within the constant regions 12, 14, 16, 18.

The angular distance between two adjacent vanes 2 is smaller than the angular distance between the opening of the inlet 31 which feeds into the pump space and the opening of the outlet 32 which feeds into the pump space. This prevents a delivery cell 4 from being able to assume a position in which it bridges or shorts the inlet 31 and the outlet 32. Alternatively or additionally, the angular distance between two adjacent vanes 2 is smaller than the angular distance between the opening of the inlet 35 which feeds into the pump space and the opening of the outlet 36 which feeds into the pump space. Again, this prevents a delivery cell 4 from being able to assume a position in which it bridges or shorts the inlet 35 and the outlet 36.

The angular distance between two adjacent vanes 2 is smaller than the angular distance between the opening of the first outlet 32 which feeds into the pump space and the opening of the second inlet 35 which feeds into the pump space. This prevents a delivery cell 4 from being able to assume a position in which it bridges or shorts the outlet 32 and the inlet 35. Alternatively or additionally, the angular distance between two adjacent vanes 2 is smaller than the angular distance between the opening of the second outlet 36 which feeds into the pump space and the opening of the first inlet 31 which feeds into the pump space. This prevents a delivery cell 4 from being able to assume a position in which it bridges or shorts the outlet 36 and the inlet 31.

The sub-vane cavity 23 of the second end-facing wall 20 lies axially opposite the sub-vane cavity 33. The sub-vane cavities 23, 33 are similar to each other. They are both arranged in the first ascending region 11. The sub-vane cavity 24 lies axially opposite the sub-vane cavity 34. The sub-vane cavities 24, 34 are similar to each other. They are both arranged in the first descending region 13. The sub-vane cavity 27 lies axially opposite the sub-vane cavity 37. The sub-vane cavities 27, 37 are similar to each other. They are both arranged in the second ascending region 15. The sub-vane cavity 28 lies axially opposite the sub-vane cavity 38. The sub-vane cavities 28, 38 are similar to each other. They are both arranged in the second descending region 17. The projection of the respective sub-vane cavity 23, 24, 27, 28 of the second end-facing wall 20 along the rotational axis R overlaps the sub-vane cavity 33, 34, 37, 38 of the first end-facing wall 30 which lies respectively opposite it, and vice versa. In FIG. 3, a portion of the sub-vane cavity 24 which overlaps the sub-vane cavity 34 in the projection is indicated in the form of a dotted line in which the control edge 242 is correspondingly marked. In FIG. 4, the projection of the control edge 342 is indicated in the form of a dotted line. The projection of the control edge 271 is also indicated in FIG. 3 in the form of a dotted line. In FIG. 4, a portion of the sub-vane cavity 37 which overlaps the sub-vane cavity 27 in the projection is indicated in the form of a dotted line in which the control edge 371 is correspondingly marked.

In particular, a sub-vane chamber 3 can be connected in fluid communication with the sub-vane cavities 23 and 33 in a rotational angular position of the rotor 1 in which the vane 2 assigned to it is situated in the first ascending region 11, in fluid communication with the sub-vane cavities 24 and 34 in a rotational angular position of the rotor 1 in which the vane 2 assigned to it is situated in the first descending region 13, in fluid communication with the sub-vane cavities 27 and 37 in a rotational angular position of the rotor 1 in which the vane 2 assigned to it is situated in the second ascending region 15, and in fluid communication with the sub-vane cavities 27 and 38 in a rotational angular position of the rotor 1 in which the vane 2 assigned to it is situated in the second descending region 17.

As can be seen from FIGS. 3 and 4, the control edge 342 and the control edge 242, which is in particular similar, are arranged angularly offset, in relation to the rotational axis R as the apex (in the projection along the rotational axis R), with respect to each other. This causes the sub-vane chamber 3 of a vane 2 to firstly be separated from the sub-vane cavity 34 when the rotor 1 is rotated in the rotational direction envisaged for operations (see the rotational direction arrows in FIGS. 3 and 4) and then separated from the sub-vane cavity 24, in particular when the rotor 1 is rotated further by a rotational angle by which the control edges 342 and 242 are angularly offset about the rotational axis R as the apex. The rotor 1 can be rotated about the rotational axis R into an angular position or can exhibit an angular position in which a sub-vane chamber 3 is connected in fluid communication with the sub-vane cavity 24 and separated from the sub-vane cavity 34. The control edges 242 and 342 can for example be angularly offset about the rotational axis R as the apex by an angle which is greater than 0°, in particular greater than 5° and advantageously greater than 10° and/or less than 30°.

In alternative embodiments, the angular offset between the control edges 342 and 242 can be reversed. This can cause the rotor 1 to be able to be rotated into an angular position or to exhibit an angular position in which a sub-vane chamber 3 is connected in fluid communication with the sub-vane cavity 34 and separated from the sub-vane cavity 24.

The rotor 1 can be rotated or rotated further about the rotational axis R, in particular from the angular position in which a sub-vane chamber 3 is connected in fluid communication with the sub-vane cavity 24 and separated from the sub-vane cavity 34, into an angular position or can exhibit an angular position in which the sub-vane chamber 3 is separated from the sub-vane cavity 24 and from the sub-vane cavity 34 in relation to fluid communication. In this angular position, the first opening of said sub-vane chamber 3 can in particular be at least partially or completely sealed or covered by the separating stay 345, and the second opening of said sub-vane chamber 3 can in particular be at least partially or completely sealed or covered by the separating stay 245.

As can likewise be seen from FIGS. 3 and 4, the control edge 371 and the control edge 271, which is in particular similar, are arranged angularly offset, in relation to the rotational axis R as the apex, with respect to each other. This causes the sub-vane chamber 3 of a vane 2 to firstly be connected in fluid communication with the sub-vane cavity 37 when the rotor 1 is rotated in the rotational direction envisaged for operations (see the rotational direction arrows in FIGS. 3 and 4) and then connected in fluid communication with the sub-vane cavity 27, in particular when the rotor 1 is rotated further by a rotational angle by which the control edges 371 and 271 are angularly offset. The rotor 1 can be rotated into an angular position or can exhibit an angular position in which a sub-vane chamber 3 is connected in fluid communication with the sub-vane cavity 37 and separated from the sub-vane cavity 27. The control edges 271 and 371 can for example be angularly offset about the rotational axis R as the apex by an angle which is greater than 0°, in particular greater than 5° and advantageously greater than 10° and/or less than 30°.

In alternative embodiments, the angular offset between the control edges 371 and 271 can be reversed. This can cause the rotor 1 to be able to be rotated into an angular position or to exhibit an angular position in which a sub-vane chamber 3 is connected in fluid communication with the sub-vane cavity 27 and separated from the sub-vane cavity 37.

The rotor 1 can be rotated or rotated further about the rotational axis R, in particular from the angular position in which a sub-vane chamber 3 is separated from the sub-vane cavity 24 and from the sub-vane cavity 34 in relation to fluid communication, in particular when the first opening of said sub-vane chamber 3 is at least partially or completely sealed or covered by the separating stay 345, and the second opening of said sub-vane chamber 3 is at least partially or completely sealed or covered by the separating stay 245, into an angular position or can exhibit an angular position in which the sub-vane chamber 3 is (still) separated from the sub-vane cavity 27 in relation to fluid communication and (already) connected in fluid communication with the sub-vane cavity 37.

The rotor 1 can be rotated or rotated further about the rotational axis R, in particular from the angular position in which the sub-vane chamber 3 is (still) separated from the sub-vane cavity 27 in relation to fluid communication and (already) connected in fluid communication with the sub-vane cavity 37, into an angular position or can exhibit an angular position in which the sub-vane chamber 3 is connected in fluid communication with the sub-vane cavity 27 and connected in fluid communication with the sub-vane cavity 37.

In the example shown in FIGS. 3 and 4, the angular offset between the control edges 371 and 271 about the rotational axis R as the apex is smaller than the angular offset between the control edges 342 and 242. In alternative embodiments, the angular offset between the control edges 371 and 271 can be greater than the angular offset between the control edges 342 and 242 or can be equal to the angular offset between the control edges 342 and 242.

In the example shown in the figures, the midpoint 14*m* of the constant region 14, i.e. the point in the middle (the angle bisector of the angle, formed around the rotational axis R as the apex, between the beginning and the end of the constant region 14) between the beginning and the end of the constant region 14—in relation to the rotating direction of the rotor 1, is angularly offset, about the rotational axis R as the apex, with respect to the control edges 342, 242, 371, 271.

In the projection along the rotational axis R, a straight line (see the dot-dash line in FIGS. 3 and 4) which passes through the midpoint 14*m* (see FIG. 1) and intersects the rotational axis R can in particular pass through the separating stays 345 and 245, in particular through the middle of the overlap region 346. Alternatively or additionally, the straight line can pass through the separating stays 385 and 285, in particular through the middle of the separating stays 385 and 285.

The angular offset between the control edge 342 and the midpoint 14*m*, about the rotational axis R as the apex, is different to the angular offset between the control edge 371 and the midpoint 14*m*. In the example shown, the angular offset between the control edge 342 and the midpoint 14*m* is greater than the angular offset between the control edge 371 and the midpoint 14*m*. This results in a separating stay 345 on the first end-facing wall 30 which is predominantly displaced towards the first descending region. Alternatively, the angular offset between the control edge 342 and the midpoint 14*m* could be smaller than or equal to the angular offset between the control edge 371 and the midpoint 14*m*.

The angular offset between the control edge 242 and the midpoint 14*m*, about the rotational axis R as the apex, is different to the angular offset between the control edge 271 and the midpoint 14*m*. In the example shown, the angular offset between the control edge 242 and the midpoint 14*m* is smaller than the angular offset between the control edge 271 and the midpoint 14*m*. This results in a separating stay 245 on the second end-facing wall 20 which is predominantly displaced towards the second ascending region. Alternatively, the angular offset between the control edge 242 and the midpoint 14*m* could be greater than or equal to the angular offset between the control edge 271 and the midpoint 14*m*.

In the example shown in the figures, the angular offset between the midpoint of the separating stay 385 formed between the control edges 331 and 382 (the angle bisector of the angle, formed around the rotational axis R as the apex, between the control edges 331 and 382) and the midpoint of the separating stay 345 formed between the control edges 342 and 371 (the angle bisector of the angle, formed around the rotational axis R as the apex, between the control edges 342 and 371) about the rotational axis R as the apex is not equal to 180° and is in particular smaller than 180° as measured across the region in which the sub-vane cavities 33 and 34 lie. Alternatively, the angular offset could be greater, as measured across the region in which the sub-vane cavities 33 and 34 lie. In another alternative, the angular offset could measure 180°.

In the example shown in FIGS. 3 and 4, the control edges 331 and 231 are not angularly offset with respect to each other and/or the control edges 382 and 282 are not angularly offset with respect to each other. If, for example, the control edges 381 and 281 are not angularly offset, about the rotational axis R as the apex, with respect to each other, the fluid communication of a sub-vane chamber 3 can be simultaneously separated from the sub-vane cavities 28 and 38 by rotating the rotor 1 about the rotational axis R. If, for example, the control edges 331 and 231 are not angularly offset, about the rotational axis R as the apex, with respect to each other, a sub-vane chamber 3 can be simultaneously connected in fluid communication with the sub-vane cavities 23 and 33 by rotating the rotor 1 about the rotational axis R.

Alternative embodiments are nonetheless possible in which the control edges 331 and 231 are angularly offset with respect to each other and/or the control edges 382 and 282 are angularly offset with respect to each other. By rotating the rotor 1 about the rotational axis R, one of the sub-vane chambers 3 is firstly separated from one of the sub-vane cavities 28, 38 (while it is still connected to the other of the sub-vane cavities 28, 38), and by further rotating the rotor 1 about the rotational axis R, the sub-vane chamber 3 is separated from the other of the sub-vane cavities 28, 38. Alternatively or additionally, one of the sub-vane chambers 3 is firstly connected in fluid communication with one of the sub-vane cavities 23, 33 (while it is not yet connected to the other of the sub-vane cavities 23, 33) by rotating the rotor 1 about the rotational axis R, and the sub-vane chamber 3 is connected in fluid communication with the other of the sub-vane cavities 23, 33 by further rotating the rotor 1 about the rotational axis R.

In the example shown in the figures, the midpoint 18*m* of the constant region 18, i.e. the point in the middle (the angle bisector of the angle, formed around the rotational axis R as the apex, between the beginning and the end of the constant region 18) between the beginning and the end of the constant region 18—in relation to the rotating direction of the rotor 1, is angularly offset, about the rotational axis R as the apex, with respect to the control edges 331, 231, 382, 282.

In the projection along the rotational axis R, a straight line (see the dot-dash line in FIGS. 3 and 4) which passes through the midpoint 18*m* (see FIG. 1) and intersects the rotational axis R can in particular pass through the separating stays 285 and 385, in particular through the middle of the separating stays 285 and 385. In the example shown, the straight line corresponds to the straight line described further above, which passes through the midpoint 14*m* and intersects the rotational axis R.

In the example shown, the angular offset between the control edge 382 and the midpoint 18*m*, about the rotational axis R as the apex, is equal to the angular offset between the control edge 331 and the midpoint 18*m*. Alternatively, the angular offset between the control edge 382 and the midpoint 18*m*, about the rotational axis R as the apex, could be smaller than or greater than the angular offset between the control edge 331 and the midpoint 18*m*.

In the example shown, the angular offset between the control edge 282 and the midpoint 18*m*, about the rotational axis R as the apex, is equal to the angular offset between the control edge 231 and the midpoint 18*m*. Alternatively, the angular offset between the control edge 282 and the midpoint 18*m*, about the rotational axis R as the apex, could be smaller than or greater than the angular offset between the control edge 231 and the midpoint 18*m*.

In the example shown, the angular offset between the control edges 341 and 342 is smaller than the angular offset between the control edges 371 and 372 and/or the angular offset between the control edges 331 and 332. Alternatively or additionally, the angular offset between the control edges 241 and 242 is greater than, smaller than or equal to the angular offset between the control edges 271 and 272 and/or the angular offset between the control edges 231 and 232.

The width of the separating stay 345 between the control edges 342 and 371 and/or the width of the separating stay 385 between the control edges 382 and 331 is greater than the width of the first opening via which the sub-vane chamber 3 feeds towards the first end-facing wall 30. This causes the separating stay 345 or the separating stay 385 to be able to completely seal the relevant opening of the sub-vane chamber 3 in a rotational position of the rotor 1.

The width of the separating stay 245 between the control edges 242 and 271 and/or the width of the separating stay 285 between the control edges 282 and 231 is greater than the width of the opening via which the sub-vane chamber 3 feeds towards the second end-facing wall 20. This causes the separating stay 245 or the separating stay 285 to be able to completely seal the relevant opening of the sub-vane chamber in a rotational position of the rotor 1.

The angular distance between the control edges 242 and 371 or the distance 346, in particular the overlap region between the separating stays 245 and 345 (FIG. 3), between the control edges 242 and 371 in the projection along the rotational axis R is greater than or alternatively smaller than or equal to the width of the openings via which a sub-vane chamber 3 feeds towards the first end-facing wall 30 and the second end-facing wall 20. The rotor 1 can assume or exhibit a rotational position in which the separating stay 345 seals the opening of a sub-vane chamber 3 which feeds towards the first end-facing wall 30, and the separating stay 245 seals the opening of a sub-vane chamber 3 which feeds towards the second end-facing wall 20, for example when the distance 346 is greater than or equal to the width of the openings of the relevant sub-vane chamber 3.

Alternatively, the rotor 1 could assume or exhibit a rotational position in which the opening of a sub-vane chamber 3 which feeds towards the first end-facing wall 30 is connected in fluid communication with the sub-vane cavity 37, and the opening of said sub-vane chamber 3 which feeds towards the second end-facing wall 20 is connected in fluid communication with the sub-vane cavity 24, for example when the distance 346 is smaller than the width of the openings of the relevant sub-vane chamber 3. In alternative embodiments, in which the angular offset between the control edges 342 and 242 is reversed with respect to the representation in FIG. 3, the rotor 1 can assume or exhibit a rotational position in which the opening of a sub-vane chamber 3 which feeds towards the first end-facing wall 30 is connected in fluid communication with the sub-vane cavity 34, and the opening of said sub-vane chamber 3 which feeds towards the second end-facing wall 20 is connected in fluid communication with the sub-vane cavity 27.

It is generally preferred if the midpoint of the distance 346 (FIG. 3), resultant in the projection along the rotational axis R, between the control edges 242 and 371 (the angle bisector of the angle around the rotational axis R as the apex between the control edges 242 and 371) is not or is only insignificantly angularly offset, about the rotational axis R as the apex, in relation to the midpoint of the constant region 14 (FIG. 1; the angle bisector of the angle around the rotational axis R as the apex between the beginning and the end of the constant region 14) and/or is angularly offset by 180° or by approximately 180° in relation to the midpoint of the separating stay 385 (the angle bisector of the angle around the rotational axis R as the apex between the control edges 382 and 331) and/or separating stay 285 (the angle bisector of the angle around the rotational axis R as the apex between the control edges 282 and 231).

The rotor 1 can be rotated into a rotational position and/or can assume or exhibit a rotational position in which the opening of a sub-vane chamber 3 which feeds towards the first end-facing wall 30 is at least partially or completely sealed by the separating stay 385, and the opening of said sub-vane chamber 3 which feeds towards the second end-facing wall 20 is at least partially or completely sealed by the separating stay 285.

In the example shown in the figures, the angular distance between the control edges 341 and 342 of the first descending sub-vane cavity 34 of the first end-facing wall 30, around the rotational axis R as the apex, is smaller than the angular distance between the control edges 381 and 382 of the second descending sub-vane cavity 38 of the first end-facing wall 30. Alternatively or additionally, the angular distance between the control edges 241 and 242 of the first descending sub-vane cavity 24 of the second end-facing wall 20, around the rotational axis R as the apex, is greater than the angular distance between the control edges 281 and 282 of the second descending sub-vane cavity 28 of the second end-facing wall 20.

Furthermore, in the example shown in the figures, the angular distance between the control edges 371 and 372 of the second ascending sub-vane cavity 37 of the first end-facing wall 30, around the rotational axis R as the apex, is greater than the angular distance between the control edges 331 and 332 of the first ascending sub-vane cavity 33 of the first end-facing wall 30. Alternatively or additionally, the angular distance between the control edges 271 and 272 of the second ascending sub-vane cavity 27 of the second end-facing wall 20, around the rotational axis R as the apex, is smaller than the angular distance between the control edges 231 and 232 of the first ascending sub-vane cavity 23 of the first end-facing wall 30.

In the example shown in the figures, the midpoint of the separating stay 335 between the control edges 332 and 341 (the angle bisector of the angle around the rotational axis R as the apex between the control edges 332 and 341) is angularly offset, about the rotational axis R, by 180° with respect to the midpoint of the separating stay 375 between the control edges 372 and 381 (the angle bisector of the angle around the rotational axis R as the apex between the control edges 372 and 381).

Alternatively or additionally, the angular distance between the midpoint of the separating stay 335 (the angle bisector of the angle around the rotational axis R as the apex between the control edges 332 and 341) and the midpoint of the separating stay 345 (the angle bisector of the angle around the rotational axis R as the apex between the control edges 342 and 371), around the rotational axis R as the apex, is smaller than the angular distance between the midpoint of the separating stay 375 (the angle bisector of the angle around the rotational axis R as the apex between the control edges 372 and 381) and the midpoint of the separating stay 385 (the angle bisector of the angle around the rotational axis R as the apex between the control edges 382 and 331), around the rotational axis R as the apex.

Alternatively or additionally, the angular distance between the midpoint of the protrusion 235 (the angle bisector of the angle around the rotational axis R as the apex between the control edges 232 and 241) and the midpoint of the separating stay 245 (the angle bisector of the angle around the rotational axis R as the apex between the control edges 242 and 271), around the rotational axis R as the apex, is greater than the angular distance between the midpoint of the protrusion 275 (the angle bisector of the angle around the rotational axis R as the apex between the control edges 272 and 281) and the midpoint of the separating stay 285 (the angle bisector of the angle around the rotational axis R as the apex between the control edges 282 and 231), around the rotational axis R as the apex.

LIST OF REFERENCE SIGNS

1 rotor
2 vane
3 sub-vane chamber
4 delivery cell
5 shaft
6 bolt
7 first gasket
8 second gasket
9*a* first delivery chamber
9*b* second delivery chamber
10 contour ring/stroke ring
101 inner contour
102 channel/connecting channel
103 channel/connecting channel
11 first ascending region
12 constant region (upper reverse region)
121 dead centre
13 first descending region
14 constant region (lower reverse region)
141 dead centre
14*m* midpoint
15 second ascending region
16 constant region (upper reverse region)
161 dead centre
17 second descending region
18 constant region (lower reverse region)
181 dead centre
18*m* midpoint
20 second housing part/second end-facing wall
21 first inlet
22 first outlet
221 cavity/groove-shaped channel
23 first ascending sub-vane cavity/groove
231 control edge/beginning of the sub-vane cavity 23
232 control edge/end of the sub-vane cavity 23
235 protrusion
24 first descending sub-vane cavity/groove
241 control edge/beginning of the sub-vane cavity 24
242 control edge/end of the sub-vane cavity 24
245 separating stay
25 second inlet
26 second outlet
27 second ascending sub-vane cavity/groove
271 control edge/beginning of the sub-vane cavity 27
272 control edge/end of the sub-vane cavity 27
275 protrusion
279 channel
28 second descending sub-vane cavity/groove
281 control edge/beginning of the sub-vane cavity 28
282 control edge/end of the sub-vane cavity 28
285 separating stay
30 first housing part/first end-facing wall
31 first inlet
32 first outlet
33 first ascending sub-vane cavity/groove
331 control edge/beginning of the sub-vane cavity 33
332 control edge/end of the sub-vane cavity 33
333 transition
334 channel
335 separating stay
34 first descending sub-vane cavity/groove
341 control edge/beginning of the sub-vane cavity 34
342 control edge/end of the sub-vane cavity 34
345 separating stay
346 overlap between the separating stays 345 and 245
35 second inlet
36 second outlet
37 second ascending sub-vane cavity/groove
371 control edge/beginning of the sub-vane cavity 37
372 control edge/end of the sub-vane cavity 37
373 transition
374 channel
375 separating stay
38 second descending sub-vane cavity/groove
381 control edge/beginning of the sub-vane cavity 38
382 control edge/end of the sub-vane cavity 38
385 separating stay
39 channel
R rotational axis of the rotor

The invention claimed is:

1. A vane cell pump, comprising:

a rotor, which is adapted to be rotated about a rotational axis, and a plurality of vanes which are guided by the rotor such that the plurality of vanes are adapted to be shifted when the rotor rotates, wherein the rotor comprises a sub-vane chamber for each vane of the plurality of vanes, and each vane forms a shifting wall of the sub-vane chamber assigned to it;

a first end-facing wall which adjoins the rotor on an end-facing side on a first side of the rotor and which, in order to control pressure to the sub-vane chamber, comprises a sub-vane cavity which extends in a circumferential direction of the rotor;

a second end-facing wall which adjoins the rotor on an end-facing side on a second side of the rotor and which, in order to control pressure to the sub-vane chamber, comprises a sub-vane cavity which extends in the circumferential direction and lies opposite the sub-vane cavity of the first end-facing wall, wherein the first end-facing wall comprises a separating stay which fluidically separates the respective sub-vane chamber of the plurality of vanes from the sub-vane cavity of the first end-facing wall in a rotational position of the rotor, while said respective sub-vane chamber of the plurality of vanes is situated in a region of the separating stay of the first end-facing wall, and the second end-facing wall comprises a separating stay which is opposite the separating stay of the first end-facing wall and which fluidically separates the respective sub-vane chamber of the plurality of vanes from the sub-vane cavity of the second end-facing wall in a rotational position of the rotor, while said respective sub-vane chamber of the plurality of vanes is situated in a region of the separating stay of the second end-facing wall, wherein the separating stay of the first end-facing wall and the opposite separating stay of the second end-facing wall are arranged angularly offset about the rotational axis with respect to each other, wherein the separating stay of the first end-facing wall and the opposite separating stay of the second end-facing wall overlap in a projection along the rotational axis partially in an overlap region.

2. The vane cell pump according to claim 1, wherein a control edge of the sub-vane cavity of the first end-facing wall, and a control edge of the sub-vane cavity of the second end-facing wall which is similar to it, each form an end or a beginning of the respective sub-vane cavity in relation to the rotating direction of the rotor.

3. The vane cell pump according to claim 2, wherein a contour ring comprising an inner contour which extends around the rotational axis of the rotor and along which the plurality of vanes slide when the rotor is rotated, wherein the inner contour of the contour ring is adapted to define at least one ascending region and at least one descending region, wherein a vane is moved out of the rotor as it slides over the ascending region and is moved into the rotor as it slides over the descending region, wherein a region of the inner contour between the descending region and the ascending region is formed so as to define a lower dead centre for the plurality of vanes, at which the direction of movement of a vane of the plurality of vanes in relation to the rotor is reversed when said vane slides from the descending region to the ascending region via the lower dead centre, wherein an angular distance around the rotational axis of the rotor between the lower dead centre and the control edge of the sub-vane cavity of the first end-facing wall and an angular distance around the rotational axis of the rotor between the lower dead centre and the similar control edge of the sub-vane cavity of the second end-facing wall, are different in size.

4. The vane cell pump according to claim 3, wherein the inner contour of the contour ring is adapted to define at least one first ascending region, at least one first descending region, at least one second ascending region and at least one second descending region, wherein a region defining the lower dead centre is arranged between the first descending region and the second ascending region or between the second descending region and the first ascending region.

5. The vane cell pump according to claim 2, wherein the rotor exhibits or is adapted to assume a rotational position in which the sub-vane cavity of the first end-facing wall is connected in fluid communication with one of the sub-vane chambers of the plurality of vanes and the opposite sub-vane cavity of the second end-facing wall is likewise connected in fluid communication with said one sub-vane chamber, a rotational position in which the sub-vane cavity of the first end-facing wall is fluidically separated from another one of the sub-vane chambers of the plurality of vanes and the opposite sub-vane cavity of the second end-facing wall is connected in fluid communication with said another sub-vane chamber, or a rotational position in which the sub-vane cavity of the second end-facing wall is fluidically separated from yet another one of the sub-vane chambers and the opposite sub-vane cavity of the first end-facing wall is connected in fluid communication with said yet another sub-vane chamber.

6. The vane cell pump according to claim 1, wherein the rotor exhibits or is adapted to assume a rotational position in which the sub-vane cavity of the first end-facing wall is connected in fluid communication with one of the sub-vane chambers and the opposite sub-vane cavity of the second end-facing wall is likewise connected in fluid communication with said sub-vane chamber, a rotational position in which the sub-vane cavity of the first end-facing wall is fluidically separated from one of the sub-vane chambers of the plurality of vanes and the opposite sub-vane cavity of the second end-facing wall is connected in fluid communication with said one sub-vane chamber, or a rotational position in which the sub-vane cavity of the second end-facing wall is fluidically separated from another one of the sub-vane chambers of the plurality of vanes and the opposite sub-vane cavity of the first end-facing wall is connected in fluid communication with said another sub-vane chamber.

7. The vane cell pump according to claim 1, wherein the width, extending in the circumferential direction, of the overlap region is smaller than the width, extending in the circumferential direction, of the sub-vane chamber opening which points towards the first end-facing side or the sub-vane chamber opening which points towards the second end-facing side.

8. The vane cell pump according to claim 1, wherein a region defining a lower dead centre is arranged within an angular range of the separating stay of the first end-facing wall or within an angular range of the separating stay of the second end-facing wall and within an angular range of the overlap region.

9. The vane cell pump according to claim 1, wherein the vane cell pump is adapted such that while the rotor is being rotated, a sub-vane chamber is connected in fluid communication with a sub-vane cavity, arranged in the descending region, of one end-facing wall, until said sub-vane chamber is or comes to be connected in fluid communication with the sub-vane cavity, arranged in the ascending region, of the other end-facing wall.

10. A vane cell pump, comprising:

a rotor, which is adapted to be rotated about a rotational axis, and a plurality of vanes which are guided by the rotor such that the plurality of vanes are adapted to be shifted when the rotor rotates, wherein the rotor comprises a sub-vane chamber for each vane of the plurality of vanes, and each vane of the plurality of vanes forms a shifting wall of the sub-vane chamber assigned to it;

a contour ring comprising an inner contour which extends around the rotational axis and along which the vanes slide when the rotor is rotated, wherein the inner contour of the contour ring is adapted to define at least one ascending region and at least one descending region, wherein a vane is moved out of the rotor as it slides over the ascending region and is moved into the rotor as it slides over the descending region, wherein the inner contour between the descending region and the ascending region comprises a region which defines a lower dead centre for the vane which passes therethrough, and the inner contour between the ascending region and the descending region comprises region which defines an upper dead centre for the vane which passes therethrough;

a first end-facing wall which adjoins the rotor on an end-facing side on a first side of the rotor;

a second end-facing wall which adjoins the rotor on an end-facing side on a second side of the rotor, wherein the first end-facing wall and the second end-facing wall each comprise:

at least one ascending sub-vane cavity, in fluid communication with which the sub-vane chamber is connected when its vane is situated in the ascending region of the contour ring;

at least one descending sub-vane cavity, in fluid communication with which the sub-vane chamber is connected when its vane is situated in the descending region of the contour ring; and a separating stay which is formed between and fluidically separates the descending sub-vane cavity and the ascending sub-vane cavity in the area of the lower dead centre, wherein the separating stay which is formed between the descending sub-vane cavity and the ascending sub-vane cavity of the first end-facing wall is arranged such that it is angularly offset about the rotational axis with respect to the separating stay which lies opposite the separating stay of the first end-facing wall along or parallel to the rotational axis and which is formed between the descending sub-vane cavity and the ascending sub-vane cavity of the second end-facing wall, wherein one of the first and second end-facing walls comprises a separating stay which is formed between the ascending sub-vane and the descending sub-vane cavity in the area of the upper dead centre, and which forms a channel which is open toward the rotor and connects the ascending sub-vane cavity in fluid communication with the descending sub-vane cavity.

11. The vane cell pump according to claim 10, wherein the mutually opposite and angularly offset separating stays partially overlap in a projection along or parallel to the rotational axis.

12. A vane cell pump, wherein the vane cell pump is formed as one of a multi-flux, a dual-flux, a multi-stroke and a two-stroke vane cell pump, further comprising:

a contour ring comprising an inner contour which extends around the rotational axis and along which vanes slide when a rotor of the vane cell pump is rotated, wherein the inner contour of the contour ring is adapted to define a first ascending region and a first descending region which are assigned to a first flux, and at least a second ascending region and a second descending region which are assigned to a second flux, wherein a vane is moved out of the rotor as it slides over the first or second ascending region and is moved into the rotor as it slides over the first or second descending region;

a first end-facing wall which adjoins the rotor on an end-facing side on a first side of the rotor; and a second end-facing wall which adjoins the rotor on an end-facing side on a second side of the rotor, wherein one of i) the first end-facing wall and second end-facing wall, or ii) the first end-facing wall and the second end-facing wall, comprises:

a first ascending sub-vane cavity, in fluid communication with which a sub-vane chamber is connected when its vane is situated in the first ascending region of the contour ring;

a first descending sub-vane cavity, in fluid communication with which a sub-vane chamber is connected when its vane is situated in the first descending region of the contour ring;

a second ascending sub-vane cavity, in fluid communication with which a sub-vane chamber is connected when its vane is situated in the second ascending region of the contour ring;

a second descending sub-vane cavity, in fluid communication with which a sub-vane chamber is connected when its vane is situated in the second descending region of the contour ring;

a separating stay which is formed between the first descending sub-vane cavity and the second ascending sub-vane cavity; and a separating stay which is formed between the second descending sub-vane cavity and the first ascending sub-vane cavity, wherein the separating stays are offset, about the rotational axis as an apex, with respect to each other by an angle which is not equal to 180°.

13. The vane cell pump according to claim 12, wherein a midpoint of the separating stay formed between the first descending sub-vane cavity and the second ascending sub-vane cavity is offset by an angle which is not equal to 180° with respect to a midpoint of the separating stay formed between the second descending sub-vane cavity and the first ascending sub-vane cavity.

14. The vane cell pump according to claim 12, wherein the separating stay formed between the first descending sub-vane cavity and the second ascending sub-vane cavity is delineated in a circumferential direction of the rotor by a control edge of the first descending sub-vane cavity and by a control edge of the second ascending sub-vane cavity, and the separating stay formed between the second descending sub-vane cavity and the first ascending sub-vane cavity is delineated in the circumferential direction of the rotor by a control edge of the second descending sub-vane cavity and by a control edge of the first ascending sub-vane cavity, wherein an angle bisector of an angular distance around the rotational axis between the control edge of the first descending sub-vane cavity and the control edge of the second ascending sub-vane cavity is offset, about the rotational axis as an apex, by an angle which is not equal to 180° with respect to an angle bisector of an angular distance around the rotational axis between the control edge of the second descending sub-vane cavity and the control edge of the first ascending sub-vane cavity.

15. The vane cell pump according to claim 12, wherein the separating stay of the first end-facing wall, formed between the first descending sub-vane cavity and the second ascending sub-vane cavity is delineated in a circumferential direction of the rotor by a control edge of the first descending sub-vane cavity and by a control edge of the second ascending sub-vane cavity, wherein the separating stay of the second end-facing wall, formed between the first descending sub-vane cavity and the second ascending sub-vane cavity is delineated in the circumferential direction of the rotor by a control edge of the first descending sub-vane cavity and by a control edge of the second ascending sub-vane cavity, wherein an angle bisector of an angular distance around the rotational axis between the control edge of the first descending sub-vane cavity of the first end-facing wall and the control edge of the second ascending sub-vane cavity of the first end-facing wall is angularly offset, about the rotational axis as an apex, with respect to an angle bisector of an angular distance around the rotational axis between the control edge of the first descending sub-vane cavity of the second end-facing wall and the control edge of the second ascending sub-vane cavity of the second end-facing wall.

* * * * *